US006010740A

United States Patent [19]

Rutledge et al.

[11] Patent Number: 6,010,740

[45] Date of Patent: Jan. 4, 2000

[54] FLUID DISPENSING SYSTEM

[75] Inventors: Clinton W. Rutledge; Michael Godfrey, both of Highlands Ranch; Ian J. Buckley, Denver; William W. Weil, Golden, all of Colo.

[73] Assignee: Preferred Machining Corporation, Englewood, Colo.

[21] Appl. No.: 08/941,855

[22] Filed: Sep. 30, 1997

[51] Int. Cl.[7] ..... B05D 1/00

[52] U.S. Cl. ..... 427/8; 427/207.1; 427/208.4; 118/663; 118/665; 118/684; 118/688; 118/690; 118/699; 118/712; 118/321; 239/583; 239/584; 239/585.4

[58] Field of Search ..... 251/129.16, 129.1, 251/129.2, 129.04, 129.02, 129.01; 222/1, 23, 55, 52, 71, 544, 509, 505; 239/1, 71, 74, 583, 584, 585.4; 118/712, 680, 690, 665, 320, 321, 684, 699, 663; 427/8, 207.1, 208.4

[56] References Cited

U.S. PATENT DOCUMENTS

| | | | |
|---|---|---|---|
| 2,189,783 | 2/1940 | Eberhart | 91/45 |
| 2,587,538 | 2/1952 | Seaman | 137/139 |
| 2,732,315 | 1/1956 | Birkland | 117/43 |
| 3,001,506 | 9/1961 | Ford | 118/318 |
| 3,412,971 | 11/1968 | McDivitt | 251/137 |
| 3,521,598 | 7/1970 | Straw | 118/2 |
| 3,612,479 | 10/1971 | Smith, Jr. | 251/176 |
| 3,761,053 | 9/1973 | Bedo et al. | 251/88 |
| 3,780,981 | 12/1973 | Horak et al. | 251/144 |
| 3,852,095 | 12/1974 | Hogstrom | 117/43 |
| 4,262,629 | 4/1981 | McConnellogue et al. | 118/668 |
| 4,295,573 | 10/1981 | Terry et al. | 215/348 |
| 4,342,443 | 8/1982 | Wakeman | 251/137 |
| 4,437,488 | 3/1984 | Taggart et al. | 137/334 |
| 4,498,415 | 2/1985 | Tsuchiya et al. | 118/712 |
| 4,546,955 | 10/1985 | Beyer et al. | 251/129 |
| 4,840,138 | 6/1989 | Stirbis | 118/694 |
| 4,852,773 | 8/1989 | Standlick et al. | 222/504 |
| 4,884,720 | 12/1989 | Whigham et al. | 222/54 |
| 4,958,769 | 9/1990 | Schowiak | 239/114 |
| 5,197,508 | 3/1993 | Göttling et al. | 251/129.04 |
| 5,215,587 | 6/1993 | McConnellogue et al. | 118/699 |
| 5,263,608 | 11/1993 | Kiernan et al. | 118/688 |
| 5,419,492 | 5/1995 | Gant et al. | 239/88 |
| 5,749,969 | 5/1998 | Kobak et al. | 118/319 |

OTHER PUBLICATIONS

Techs Publication "Pressure Monitoring Control System for Reciprocating Compounding Systems", (4 pages).

Lucas Ledex, Inc. Catalog, "Series 50–L Stepping Solenoids", pp. SS–1 to SS–6, publication date unknown.

Lucas Ledex, Inc. Catalog, "Low Profile Solenoids—Push or Pull", pp. LP–1 to LP–4, publication date unknown.

*Primary Examiner*—Laura Edwards

*Attorney, Agent, or Firm*—Klaas, Law, O'Meara & Malkin, P.C.; Michael A. Goodwin, Esq.; William P. O'Meara, Esq.

[57] ABSTRACT

An apparatus and method for controlling the opening of a solenoid actuated valve in a sealant dispensing gun are disclosed. A proximity sensor is provided adjacent a portion of the needle valve stem in order to sense when the needle valve has reached its open position. A dispense timer is initiated when the proximity sensor indicates that the needle valve has reached its open position. In this manner, the needle valve may be maintained in its open position for the desired dispense time only without regard to the response time of the solenoid device. Also disclosed is an apparatus and method for adjusting the valve open limit of a sealant dispensing device which incorporates a solenoid or motor actuated valve open limit device. A flow sensor is located in-line with the sealant supply path of a dispensing gun in order to monitor the dispense weight during each valve open cycle. A moving average of the dispense rates may then be calculated and compared to predetermined limits. If the limits are exceeded, the processor the processor automatically adjusts the solenoid or motor actuated valve open limit device in the proper direction in order to bring the dispense rate back into the proper dispense rate range.

57 Claims, 17 Drawing Sheets

FLUID DISPENSING SYSTEM

FIELD OF THE INVENTION

The present invention relates generally to a fluid dispensing system and, more particularly, to a sealant delivery system and apparatus for application of a sealant compound material to container lids and closures

BACKGROUND OF THE INVENTION

It is conventional to apply sealant to the underside of container closure members in order to facilitate subsequent sealing attachment of the closure members to containers. Such sealant is normally applied in an annular pattern on the underside of each closure member in a manner such that, when the closure is attached to the container, the applied sealant will be located between the container rim and the closure member and, thus, seal the closure to the container.

One example of such a container closure is a can lid or "end", as it is often referred to in the can-making industry. During the manufacture of a can end, a sealant, such as a latex sealant, is conventionally applied to the underside of a curl region of the end. After the can is filled, the end is seamed onto the upper flange of the can and the previously applied sealant material facilitates sealing between the curl area of the end and the flange of the can to which it is attached in order to prevent leakage.

Another example of such a container closure is a bottle cap or "crown", as it is often referred to in the bottling industry. In a similar manner to the can end described above, bottle crowns are conventionally provided with a sealant material such that, when the crown is subsequently attached to a filled bottle, the sealant material will be located between the crown and the bottle, thus facilitating sealing attachment of the crown to the bottle.

To apply sealant to a container closure in a manner as described above, a sealant dispensing apparatus is generally used. Such an apparatus is often referred to in the industry, and may be referred to herein, as a "sealant dispensing gun" or simply a "gun". Such sealant dispensing guns typically include a supply line which supplies liquid sealant to the gun, and a valve, such as a needle valve, for allowing the liquid sealant to be selectively dispensed from the gun. A container closure is generally supported by a chuck member which locates the closure adjacent the gun in the desired position. The closure is then rotated at a high speed by the chuck while the sealant dispensing gun valve is opened, thus resulting in an arcuate, even application of liquid sealant onto the underside of the closure. After application, the liquid sealant cures to form a solidified ring of resilient sealing material.

The extent of the rotational coverage of sealant on the closure may be adjusted by controlling the valve "dwell time" which is a measure of the time that the valve remains in its open position. Rotational coverage of a closure member with sealant is dictated by the valve dwell time relative to the rotational speed of the chuck and attached closure member. The dispense rate of sealant through the valve may also be controlled by adjusting the extent to which the needle valve opens, also sometimes referred to herein as the "valve open limit" or simply the "open limit".

Sealant dispensing guns are conventionally found in either stationary, indexing machines or in rotary machines. In an indexing machine, a sealant dispensing gun is stationarily mounted while the container closures to be coated are indexed through the machine. An example of such an indexing sealant dispensing machine for applying sealant to bottle crowns is described in U.S. Pat. No. 3,412,971 of McDivitt for ELECTRICALLY-CONTROLLED VALVE APPARATUS AND CONTROL CIRCUIT SUITABLE FOR USE THEREIN, which is hereby incorporated by reference for all that is disclosed therein.

In a rotary machine, a plurality of sealant dispensing guns are generally mounted for rotation about an axis of rotation. A rotary can lid feed mechanism is provided having a series of pockets which locate a closure member beneath each of the rotating guns. Each of the closure members is then sequentially lifted, engaged by a chuck member and rotated while the adjacent sealant dispensing gun applies sealant thereto. Examples of rotary sealant dispensing machines are set forth in U.S. Pat. Nos. 4,262,629 of McConnellogue et al. for APPARATUS FOR APPLICATION OF SEALANT TO CAN LIDS; U.S. Pat. No. 4,840,138 of Stirbis for FLUID DISPENSING SYSTEM; U.S. Pat. No. 5,215,587 of McConnellogue et al. for SEALANT APPLICATOR FOR CAN LIDS and U.S. Pat. No. 5,749,969 of Kobak et al. for FLUID DISPENSING SYSTEM, which are hereby incorporated by reference for all that is disclosed therein.

Some sealant dispensing guns include valves which are operated by cams and mechanical linkage arrangements. In these types of machines, the valve dwell time and the valve open limit are generally dictated by the specific physical cam and cam follower arrangement used. Accordingly, adjusting the valve dwell time or valve open limit in such machines generally requires a time consuming and expensive process of replacing various mechanical elements. Examples of such mechanical actuation arrangements are illustrated in U.S. Pat. Nos. 4,262,629 and 4,840,138, referenced above.

More common in recent years, however, are sealant dispensing guns in which the sealant dispensing gun valve is actuated by an electrical solenoid device or devices. In such guns, the valve dwell time is dictated not by mechanical linkages and cams, but instead by the amount of time that the valve opening solenoid is energized. Accordingly, the use of such electrical solenoid devices allows the valve dwell time of a sealant dispensing gun to be easily varied. Examples of sealant dispensing guns utilizing electrical solenoid valve actuation devices are illustrated in U.S. Pat. Nos. 3,412,971, 5,215,587 and in 5,749,969, as previously referenced.

Since the cam actuation mechanism is eliminated in sealant dispensing guns having solenoid valve actuation devices, this type of gun generally also includes an adjustable mechanism for controlling the valve open limit. This adjustable mechanism may control the valve open limit by providing a movable stop for the valve stem or by moving the valve opening solenoid itself, or both.

In addition to solenoid valve actuation, some sealant dispensing guns also employ solenoid or motor actuated devices to adjust the valve open limit. Such guns allow remote control of the open limit and, thus, the rate at which sealant is dispensed from the gun when the valve is in its open position. Examples of sealant dispensing guns incorporating solenoid or motor actuated valve open limit devices are illustrated in U.S. Pat. Nos. 5,215,587 and 5,749,969 as previously referenced.

When applying sealant to a container closure member, it is desirable to closely control the number of rotations, or "turns" that the closure member makes while the sealant is being dispensed from the sealant dispensing gun. Since one turn equals 360 degrees of rotation, complete rotational coverage of the closure member with sealant always requires that sealant be applied for at least one turn. Some closure member manufacturers, however, desire that sealant be applied over multiple, e.g., two, turns in order to ensure comprehensive coverage. As previously described, the number of turns for which sealant is applied is determined by the time that the sealant gun valve dwells in its open position relative to the rotational speed of the chuck.

In solenoid actuated sealant dispensing guns, the valve dwell time is normally controlled by a timer which is initiated when the valve opening solenoid is first energized. After the desired amount of time passes, the timer causes the valve actuator solenoid to de-energize, thus causing the needle valve to move to its closed position. The time period set on the timer is dependent upon the rotational speed of the chuck and the number of turns of sealant coating desired.

This procedure is complicated by the fact that a solenoid "response time" exists between the time that the valve opening solenoid is first energized and the time that the valve actually moves to its open position. This response time represents the time required for the solenoid to energize to the extent necessary to cause movement of the valve member. Accordingly, in order to completely coat closure members with sealant over a specified number of turns, the time period set on the valve open timer must equal the desired valve open time plus the solenoid response time.

Further complicating this procedure is the fact that solenoid response times vary significantly over time. One cause of such response time variation is temperature fluctuation. As the ambient air in a production facility warms up during the day, for example, the valve actuator solenoid also warms, thus increasing the electrical resistance within the solenoid. As the solenoid operates, the electrical current supplied to the solenoid also creates heat in the solenoid and, thus, also contributes to increased electrical resistance in the solenoid. This increase in electrical resistance within the solenoid reduces the electrical current which flows through the solenoid and, thus, reduces the strength of the magnetic field produced by the solenoid. This reduction in magnetic field strength, in turn, reduces the response time of the solenoid.

Another factor impacting solenoid response time is the valve open limit setting. A larger valve open limit results in a larger solenoid gap when the valve is in its closed position. This larger gap increases the amount of magnetic force required to open the valve. Since additional time is required to build up this increased magnetic force within the solenoid, larger valve opening settings tend to induce longer valve actuation solenoid response times and smaller valve opening settings tend to induce shorter valve actuation solenoid response times. Valve opening settings are frequently adjusted during operation of sealant dispensing guns, thus inducing frequent variations in valve actuation solenoid response times.

Accordingly, in order to ensure that closure members are coated with a minimum number of turns, the time period set on the valve open timer must equal the desired valve open time plus the worst solenoid response time which is likely to be encountered during the day.

Many modern sealant application machines are capable of applying sealant to closure members at rates exceeding 2000 closure members per minute. In order to achieve such high-speed operation, it is necessary to rotate the rotary chucks and the attached closure members of the sealant application machines at extremely high speeds. In some machines, for example, the chucks may rotate at speeds of about 3500 rotations per minute.

In some applications, solenoid response time may vary, for example, from as fast as about 8 ms (0.008 seconds) to as slow as about 12 ms (0.012 seconds). Thus, the valve actuator solenoid response time may, at some times, be as much as about 4 ms (0.004 seconds) different than at other times, depending upon the operating conditions discussed above. In order to ensure that closure members are coated with sealant over a minimum number of turns, it is necessary to set the valve open timer for the desired valve open time plus the "worst case" valve response time. During periods when the solenoid response time is faster, however, this results in excess sealant material being deposited on the closure members. Considering the exemplary numbers set forth above, at times when the solenoid response time is at its fastest (i.e., about 8 ms (0.008 seconds)), for example, the needle valve will remain open for an extra 4 ms (0.004 seconds), during which time the chuck will rotate an extra 0.233 turns (with a chuck speed of 3500 rpm).

Accordingly, with the exemplary numbers set forth above, up to nearly a quarter turn of extra sealant material may be applied to each closure member at certain times during the operation. This excess sealant represents significant cost in wasted sealant material. Such "overturning" also can impair the ability of the closure member to be effectively sealed to a container since a portion (nearly a quarter turn in the above example) of the closure member has a thicker deposit of sealant material than the remainder of the closure member.

As previously described, the valve open limit dictates the dispense rate of sealant from a sealant dispensing gun. Thus, if the valve open limit is too large, an excessive amount of sealant may be applied to the closure members, resulting in wasted sealant material. If, on the other hand, the valve open limit is too small, then too little sealant may be applied to the closure members. This condition may impair the ability of the closure members to be properly sealed to their respective filled containers.

It has been found that, even if the valve open limit is initially properly set, the dispense rate from a sealant dispensing gun may change over time. Such fluctuations in dispense rate are believed to be caused by various factors. One such factor is the temperature of the sealant material being dispensed from the gun. The viscosity of the material tends to decrease as temperature increases and increase as temperature decreases. Since sealant material having a higher viscosity tends to flow more easily than sealant material having a relatively higher viscosity, such temperature fluctuations tend to cause corresponding fluctuations in the dispense rate of sealant material.

Another factor which may impact dispense rate is wear which commonly occurs in the nozzle portions of the dispensing guns. As sealant is dispensed over time, the nozzle openings tend to become enlarged, causing an increase in sealant dispense rate.

Sealant dispense rate may also be impacted by minor fluctuations in the pressure of the sealant material. As can be appreciated, an increase in this pressure will generally cause an increase in the dispense rate while a decrease in pressure will cause a decrease in the dispense rate.

For the reasons set forth above, it is desirable to monitor the flow rate of sealant dispensing guns over time and to adjust the valve open limit as necessary to maintain the proper flow rate. One conventional method of monitoring flow rate is a sampling technique in which closure members are weighed after application of sealant by a dispensing gun. Generally, the closure members must be heated in an oven in order to cure the sealant material prior to making this weight measurement. The difference between the measured weight and the known weight of the closure member without the sealant is indicative of the weight of sealant applied to the closure member. Based upon the weight of sealant applied, the sealant gun valve open limit may be adjusted as necessary. Closure members may be selected for weight sampling at predetermined time intervals in order to track and correct for variations in dispense rate.

The sampling method described above represents a less than ideal flow rate monitoring method for several reasons. For example, the sampling method is labor intensive. In addition, there is a lag time between when the sampled closure members are coated with sealant and when the weight measurement is actually made. Due to the high speed of most sealant dispensing gun machines, many defective closure members may be produced during this lag time.

In another known method of monitoring flow rate, a flow measuring device is provided in-line with the conduit which supplies sealant to a sealant dispensing gun. Such a flow measuring device may generally comprise a pair of pressure transducers separated by a restrictive orifice. The difference in pressure read by the two transducers is indicative of the flow rate through the orifice and conduit and is, thus, also indicative of the flow rate of the dispensing gun when the valve is opened.

In this manner, such a flow measuring device is able to monitor the rate of flow and the duration of flow and, thus, the volume and weight of flow for each valve open cycle may be calculated and displayed on an operator information panel. The machine operator may then track the weights and make adjustments to the dispensing gun valve open limit as necessary. An example of a system employing a flow measuring device as described above is disclosed in an advertising publication entitled "PMC Pressure Monitoring Control System for Reciprocating Compounding Systems" and distributed by Tech-S, 12755 Merriman Rd., Livonia, Mich. 48150, which is hereby incorporated by reference for all that is disclosed therein.

Although the flow measuring device described above reduces lag time, it still requires human operator intervention. Even when used in conjunction with sealant dispensing guns incorporating solenoid or motor actuated valve open limit devices, the data from the flow measuring device must first be handled by a human operator who must then manually make the valve open limit adjustment.

Thus, it would be generally desirable to provide an apparatus and method which overcomes these problems associated with solenoid valve response time and sealant dispense flow rate as described above.

SUMMARY OF THE INVENTION

The present invention is directed to a sealant dispensing gun of the type incorporating a needle valve for controlling the dispensing of sealant. The needle valve is actuated by a solenoid device which has an actuation response time.

A proximity sensor is provided adjacent a portion of the needle valve stem in order to sense when the needle valve has reached its open position. A dispense counter, e.g., a timer, is initiated when the proximity sensor indicates that the needle valve has reached its open position. In this manner, the needle valve may be maintained in its open position for the desired dispense time only, without regard to the response time of the solenoid device.

The present invention is also directed to an apparatus and method for adjusting the valve open limit of a sealant dispensing device which incorporates a solenoid or motor actuated valve open limit device. A flow sensor is located in-line with the sealant supply path of a dispensing gun in order to monitor the sealant flow rate and duration of flow during each valve open cycle of the dispensing gun. A computer processor may then use this data to calculate the volume and weight dispensed during each valve open cycle and may further calculate a moving average of the dispense weights. The processor may then compare this moving average to preset adjust limits in order to determine if adjustment of the dispensing gun valve open limit is required.

If adjustment is required, the processor may automatically adjust the solenoid or motor actuated valve open limit device in the proper direction in order to bring the dispense rate back into the proper dispense rate range. The signals from the flow measuring device may also be used to determine when the dispensing gun valve opens and closes. This information may be used in place of the information derived from the valve proximity sensor described above or, alternatively, may be used in addition to the valve proximity sensor information in order to detect other problems, such as a partially clogged nozzle.

DETAILED DESCRIPTION OF THE INVENTION

Figure 1:
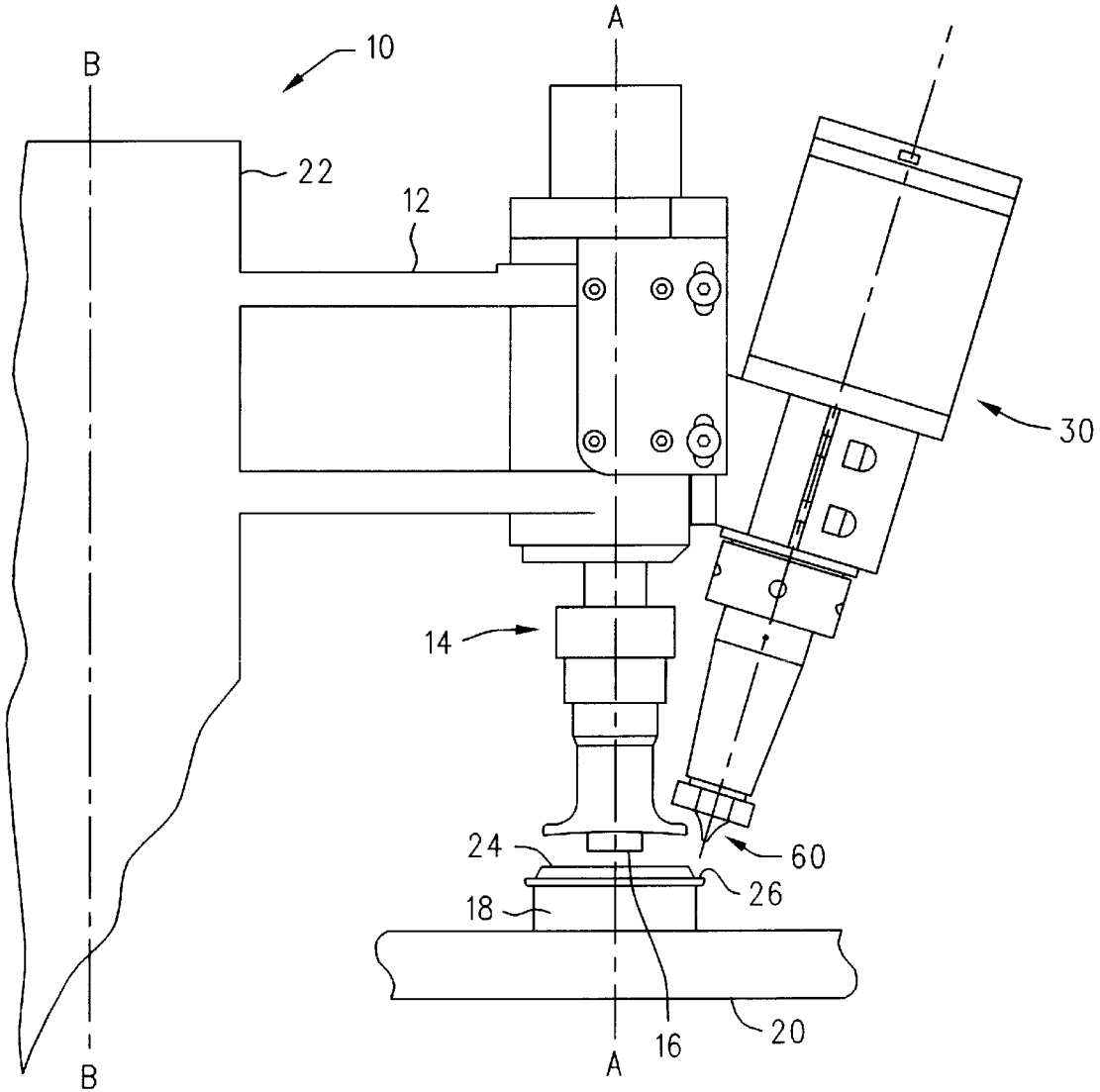
FIG. 1 is a partial cutaway view of a sealant dispensing gun, a rotary chuck member and a holding mechanism mounted for operation.

FIGS. 1–21, in general, illustrate a sealant dispensing apparatus 30 for applying sealant to container closure members 24. The dispensing apparatus 30 may include a housing 50, 110, 170; a valve seat surface 64 located within the housing 50, 110, 170; a plunger 70 including a valve portion 76, the plunger being axially movably mounted in the housing 50, 110, 170 and being selectively axially movable between a closed non-flow position in which the valve portion 76 is engaged with the valve seat surface 64 and an open sealant applying position in which the valve portion 76 is disengaged from the valve seat surface 64; an actuator 120 mounted in the housing 50, 110, 170 and operatively associated with the plunger 70; a sensor 220 located proximate at least a portion of the plunger 70; and a signal processor assembly 230 having a signal input portion operatively connected to the sensor 220 and having a signal output portion operatively connected to the actuator 120.

FIGS. 1–21 also illustrate, in general a sealant dispensing system 10 for applying sealant to container closure members 24. The sealant dispensing system may include a sealant dispensing apparatus 30 including a sealant dispensing opening 62 therein; a sealant supply source 402 located externally of the sealant dispensing apparatus 30; a sealant supply path 98 connecting the sealant supply source 402 and the sealant dispensing opening 62; a valve seat 64 located within the sealant supply path 98; a valve member 70 located within the sealant supply path 98, the valve member 70 being selectively movable between an open sealant applying position and a closed non-flow position relative to the valve seat 64; a flow gap defined between the valve seat 64 and the valve member 70 when the valve member 70 is in the open sealant applying position; a valve actuator 120 operatively connected to the valve member 70; a flow gap size adjustment solenoid 172 operatively connected to the valve actuator solenoid 120; a flow sensor 300 operatively associated with the sealant supply path 98, the flow sensor 300 adapted to sense the rate of sealant flow along the path 98; and a signal processing assembly 230 having a signal input portion operatively connected to the flow sensor 300 and a signal output portion operatively connected to the flow gap size adjustment solenoid 172.

FIGS. 1–21 also illustrate, in general a method of applying sealant to container closure members 24 with at least one sealant applying mechanism 30. The method may include the steps of providing a sealant supply source 402 located externally of the sealant applying mechanism 30; connecting the sealant supply source 402 and the sealant applying mechanism 30 with a sealant flow path; providing a valve seat 64 associated with the sealant applying mechanism 30 and located within the sealant flow path; providing a valve member 70 associated with the sealant applying mechanism 30 and located within the sealant flow path, the valve member 70 being selectively moveable between a closed non-flow position, in which the valve member 70 is in contact with the valve seat 64, and an open sealant applying position, in which a flow gap is formed between the valve member 70 and the valve seat 64; monitoring flow of sealant through the sealant flow path while sealant is applied to each of a plurality of the container closure members 24 by the sealant applying mechanism 30; and adjusting the flow gap based upon the monitoring of the flow of sealant through the sealant flow path.

FIGS. 1–21 also illustrate, in general a method of applying sealant to container closure members 24 with at least one sealant applying mechanism 30 and at least one rotatable member 18 for supporting a container closure member. The method may include the steps of providing a valve 70 located within the at least one sealant applying mechanism 30, wherein the valve 70 is movable between an open sealant dispensing position and a closed position; providing a first sensor 220, 300 adapted to sense when the valve 70 is in the open, sealant dispensing position; moving the valve 70 toward its open sealant dispensing position; sensing when the valve 70 has reached the open, sealant dispensing position with the first sensor 220, 300; maintaining the valve 70 in the open sealant dispensing position for a predetermined duration beginning substantially when the first sensor 220, 300 senses that the valve 70 is in the open sealant dispensing position.

FIGS. 1–-21 also illustrate, in general a sealant dispensing system 10, including at least one sealant applying mechanism 30, for applying sealant to container closure members 24. The system 10 may include a sealant supply 402; a fluid path providing fluid communication between the sealant supply 402 and the sealant dispensing mechanism 30; a valve seat 64 located within the sealant applying mechanism 30 and within the fluid path; a valve member 70 located within the sealant applying mechanism 30 and within the fluid path, the valve member 70 being selectively movable relative to the valve seat 64 between an open sealant applying position in which a flow gap is defined between the valve member 70 and the valve seat 64 and a closed non-flow position in which the valve member 70 is in contact with the valve seat 64; a valve actuator 120 operatively connected to the valve member 70; a first sensor 300 located within the fluid path, the first sensor 300 adapted to sense the rate of sealant flow along the fluid path; a signal processing assembly 230 having a signal input portion operatively connected to the first sensor 300 and a signal output portion operatively connected to the valve actuator 120.

Having thus described the structure and operation of the sealant dispensing device in general, the apparatus and method will now be described in further detail.

FIG. 1 illustrates an exemplary sealant application station 10 in which a sealant dispensing gun 30 is mounted to a support arm 12. Also mounted to the support arm 12 is a closure member holding mechanism 14 which may include a spring actuated plunger 16. Located below the holding mechanism 14 is a rotary chuck member 18 which rotates about the axis "AA".

The rotary chuck member 18 is adapted to support an inverted closure member, such as a can end 24, in a conventional manner. The sealant dispensing gun 30 includes a nozzle member 60 which is located adjacent the outer periphery 26 of the closure member 24 when such a closure member is mounted on the rotary chuck member 18, as shown.

To apply sealant to the closure member 24, the closure member is first located on the rotary chuck member 18 as shown in FIG. 1. The plunger 16 may then be extended in order to sense the presence of a properly located closure member 24. The holding mechanism 14 holds the closure member 24 firmly in place on the chuck member 18, causing the closure member 24 to be rotated at the same speed as the chuck member 18. As the closure member 24 is rotating, the sealant dispensing gun 30 is actuated, causing sealant to be dispensed from the nozzle 60 onto the closure member outer periphery 26 in an arcuate profile.

The sealant application station 10 may be a part of a larger rotary type machine, such as that generally shown in U.S. Pat. Nos. 4,262,629; 4,840,138 and 5,215,587 as previously referenced. In such a rotary machine, the support arm 12 would be attached to a central hub 22 and the support arm 12, holding mechanism 14 and sealant dispensing gun 30 all would rotate about a common vertical axis "BB". Further, in such a rotary machine, the rotary chuck 18 may also be housed within a rotary table member 20 which also rotates about the axis "BB". In this manner, the chuck 18 will remain positioned directly below the holding mechanism 14 at all times. It is noted that, although only one sealant application station 10 is illustrated in FIG. 1, rotary type sealant application machines generally include a plurality of such stations circumferentially spaced about the hub 22.

Alternatively, the sealant application station 10 may represent a stand-alone indexing type machine, such as that generally shown in U.S. Pat. No. 3,412,971 as previously referenced. In an indexing machine, the holding mechanism 14, sealant dispensing gun 30 and the rotary chuck axis "AA" remain stationary while closure members are sequentially indexed onto the rotary chuck 18 and coated with sealant.

Figure 2:
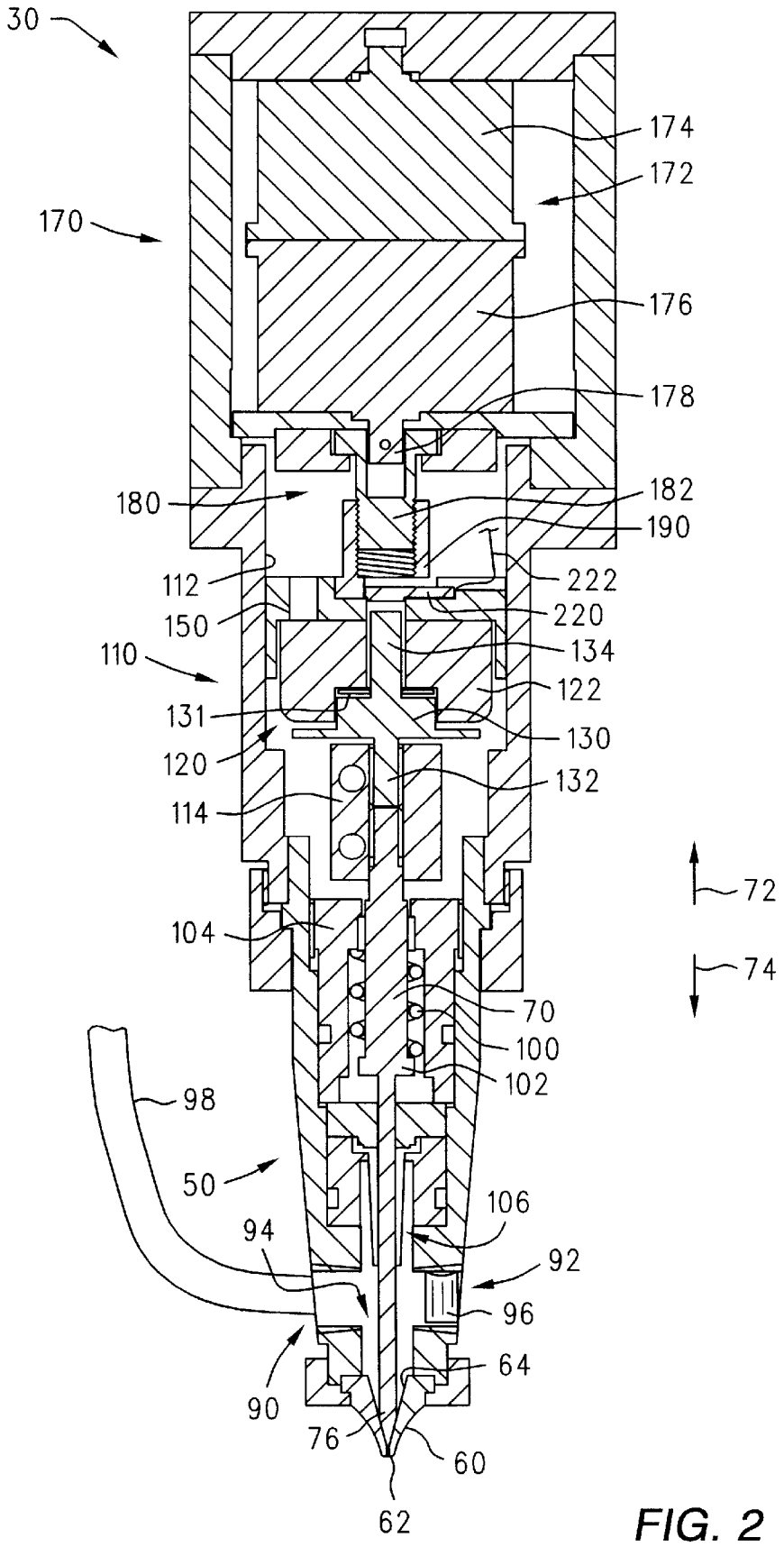
FIG. 2 is a cross-sectional elevation view of the sealant dispensing gun of FIG. 1.

FIG. 2 illustrates, in greater detail, the sealant dispensing gun 30. The gun 30 may include a lower housing portion 50, a middle housing portion 110 and an upper housing portion 170, as shown. Attached to the lower end of the lower housing portion 50 is a nozzle member 60 which may include an opening 62 through which sealant is dispensed from the gun 30. Located interiorly of the nozzle member 60 is a conical valve seat surface 64.

A needle valve member 70 is located within the lower housing 50 and is moveable relative to the lower housing 50 in the directions indicated by the arrows 72, 74. Needle valve member 70 includes a conical, tapered portion 76 at its lower end which, when the sealant dispensing gun 30 is in its closed, non dispensing position, cooperates with the nozzle member valve seat surface 64 to seal the nozzle opening 62.

A pair of openings 90, 92 in the wall member of the lower housing portion 50 communicate with a sealant chamber 94 which surrounds the needle valve member 70. When the sealant dispensing gun 30 is used to apply a water-based sealant, such as latex, one of the openings 90, 92 may be sealed off in a conventional manner as illustrated, for example, with respect to the plug 96 shown located in sealing relationship with the opening 92. A sealant supply hose 98 may be attached to the opening 90 in order to supply liquid sealant material to the sealant chamber 94. A seal member 106 may be provided in surrounding relationship to the needle valve member 70 as shown in order to prevent sealant in the sealant chamber 94 from escaping around the needle valve member 70.

A compression spring 100 may coaxially surround the needle valve member 70. The spring 100 may be located between an insert member 104, which is attached to the lower housing portion 50, and a flange member 102 integrally formed with the valve member 70. As can be appreciated, the spring 100, configured in this manner, will urge the valve member 70 in the direction 74, toward its fully closed position, as illustrated in FIG. 2.

An actuator solenoid assembly 120 may be located within the middle housing portion 110, as shown. Actuator solenoid assembly 120 may include a field portion 122 and an armature portion 130 which is moveable relative thereto in the directions 72, 74. A washer 131 may be located between the armature portion 130 and the field portion 122 as shown. Actuator solenoid field portion 122 is secured to a mounting block member 150 which may have an outside profile that closely fits within the inner surface 112 of the middle housing member 110.

The actuator solenoid armature portion 130 may include a lower extending portion 132 and an upper extending portion 134. The lower extending portion 132 is operatively attached to the upper end of the needle valve member 70 via a coupling member 114. As can be appreciated, when coupled in this manner, movement of the actuator solenoid armature 130 in the directions 72, 74 will cause corresponding movement of the needle valve member 70.

Upper housing portion 170 encloses a valve gap adjustment solenoid assembly 172 which includes a pair of rotary solenoids 174, 176. Valve gap adjustment solenoid assembly 172 also includes a rotary drive shaft member 178 which is driven in a first rotary direction when the rotary solenoid 174 is energized and in the opposite rotary direction when the rotary solenoid 176 is energized.

The valve gap adjustment solenoid assembly drive shaft member 178 is operatively connected to the actuator solenoid mounting block member 150 via a rotary to linear motion linkage assembly 180. This linkage assembly includes a drive member 182 which is coupled to the adjustment solenoid drive shaft member 178 at one end thereof and which is externally threaded at the other end thereof.

Figure 5:
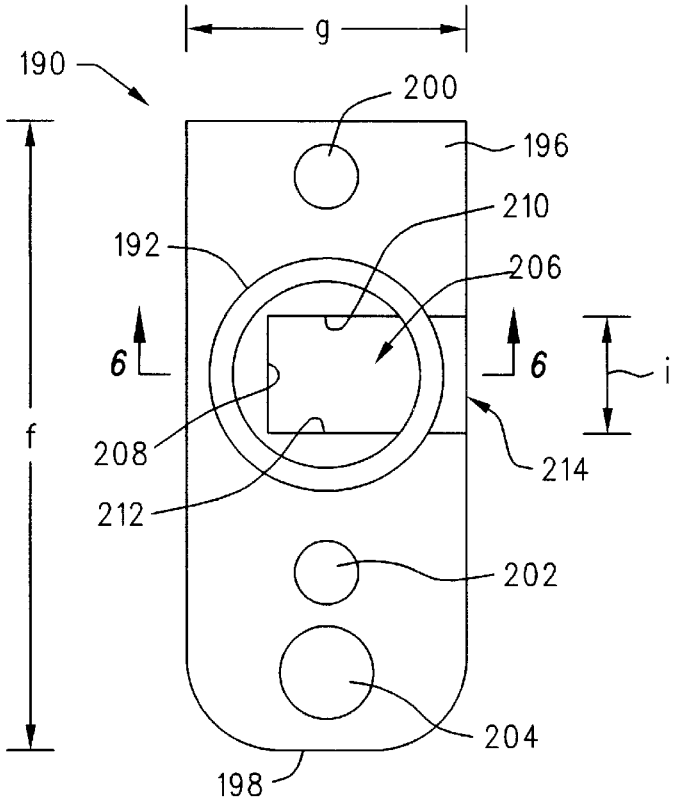
FIG. 5 is a top plan view of a transverse member of the sealant dispensing gun of FIG. 1.
Figure 6:
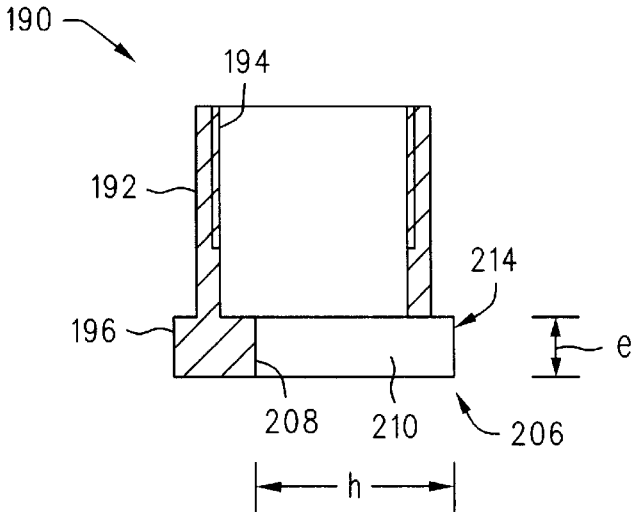
FIG. 6 is a cross-sectional elevation view taken along the line 6—6 in FIG. 5.

The externally threaded end of the drive member 182 is threadingly received within the internally threaded bore 194, FIG. 6, of a transverse member 190. The transverse member 190, in turn, is secured to the actuator solenoid assembly mounting block member 150. Transverse member 190 includes a key portion 198, FIG. 5, which engages within a slot formed in the inner wall 112 of the middle housing portion 110. In this manner, rotation of the transverse member 190 relative to the housing middle portion 110 is prevented and movement of the transverse member and attached actuator solenoid assembly 120 is restricted to the linear directions 72, 74.

As can be appreciated from the above description, rotation of the valve gap adjustment solenoid assembly 172 will cause rotation of the drive member 182. Rotation of the drive member 182 relative to the non-rotatable transverse member 190 will cause movement of the transverse member 190, the mounting block member 150 and the solenoid assembly 120 in the directions 72, 74.

In operation of the sealant dispensing gun 30, pressurized sealant is delivered to the sealant chamber 94 via the sealant supply line 98. When sealant is to be dispensed from the gun 30, the actuator solenoid assembly 120 is energized, causing the solenoid armature portion 130 and the attached needle valve member 70 to move in the direction 72 until the armature portion 130 bottoms out on the washer 131. This causes the needle valve tapered portion 76 to unseat from the nozzle valve seat surface, allowing sealant to flow from the sealant chamber 94 out of the gun through the nozzle opening 62.

When the actuator solenoid assembly 120 has been energized for a predetermined period of time, it is de-energized, allowing the spring 100 to force the needle valve member 70 in the direction 74, thus causing the needle valve tapered portion 76 to once again seat within the nozzle valve seat surface 64 and close the nozzle opening 62.

The distance that the needle valve member 70 moves in the direction 72 when the actuator solenoid assembly 120 is energized may be adjusted by selectively energizing the adjustment solenoids 174, 176. Such adjustment will cause the actuator solenoid assembly 120 to move in the directions 72, 74 and, thus, adjust the limit of movement of the needle valve member 70 in the direction 72.

It is noted that the sealant dispensing gun 30 described above may be substantially identical to that disclosed in U.S. Pat. No. 5,749,969, as previously referenced.

Valve Open Dwell Time Control

As previously described, the performance of traditional solenoid actuated sealant dispensing guns is often impaired by the response time of the actuator solenoids and by the variations which occur in this response time. The response time variation represents a particular problem in high-speed applications.

Figure 3:
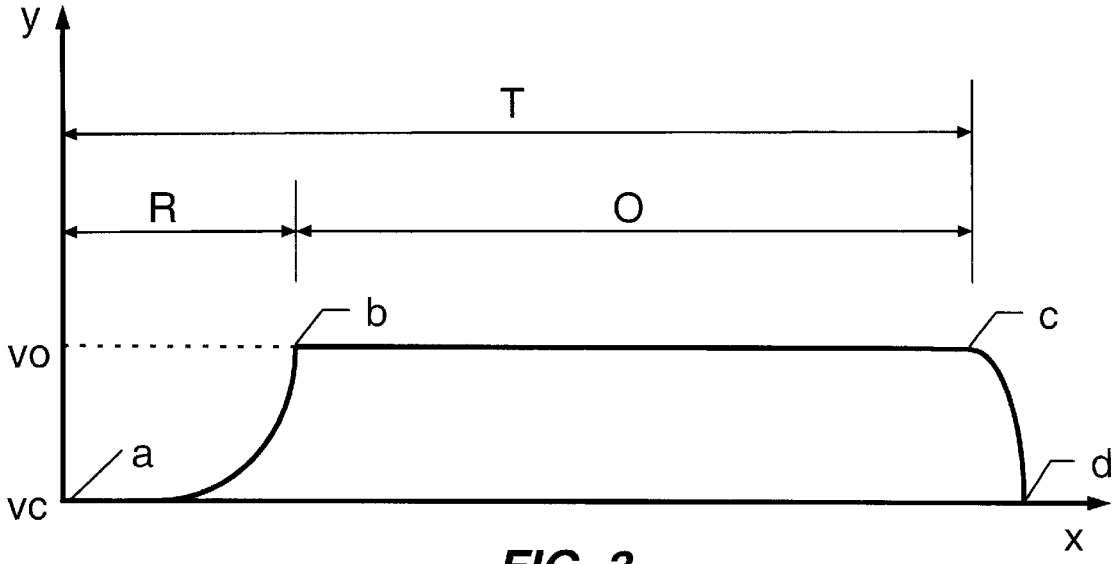
FIG. 3 is a schematic illustration of one cycle of the sealant dispensing gun of FIG. 1 in a solenoid response time worst case situation.
Figure 4:
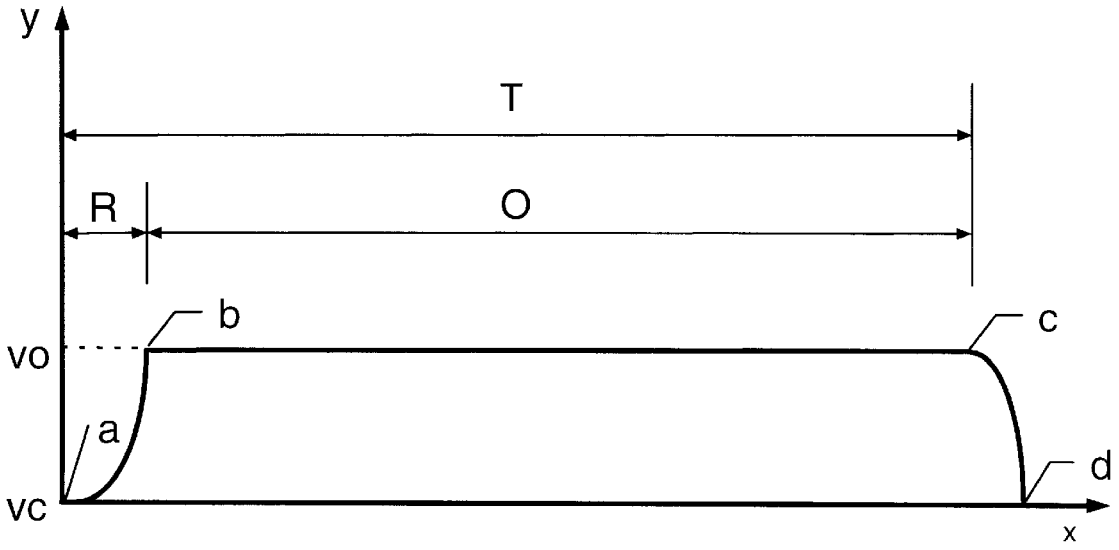
FIG. 4 is a schematic illustration similar to FIG. 3, but depicting a solenoid response time which is faster than the worst case situation.

FIGS. 3 and 4 schematically illustrate the operation of a solenoid actuated sealant dispensing gun needle valve with time indicated on the x axis and the degree of valve opening indicated on the y axis. The operation of the valve is illustrated between its valve closed position "vc" and its valve open position "vo".

Referring to FIG. 3, the point "a" represents the point at which the actuator solenoid is first energized. Point "b" represents the point at which the needle valve actually reaches its open position. The time span "R" between the points "a" and "b", thus, represents the response time of the actuator solenoid. Point "c" represents the point at which the actuator solenoid is de-energized and point "d" is the point at which the needle valve actually reaches its closed position. Because the points "c" and "d" occur so closely in time, for purposes of this discussion, they will be considered to occur simultaneously. Accordingly, the time span "O" may be considered to represent the time that the needle valve actually remains in the open position.

The time span "T", extending between the points "a" and "c", represents the time that is set on the actuator solenoid timer. In other words, the timer is started when the solenoid is actuated at the point "a". After the predetermined period of time "T" has been counted on the timer, the actuator solenoid is de-energized at point "c".

As previously discussed, in a conventional solenoid actuated dispensing gun, the time "T" must be set to equal the actual desired valve open time "O" plus the solenoid response time "R". As also previously discussed, however, the solenoid response time "R" is not constant, but instead varies depending upon factors, such as heat. Accordingly, in order to ensure complete coverage of closure members with sealant, the time "R" used to set the time "T" must be chosen to be equal to the "worst case" time "R", i.e., the longest solenoid response time "R" which will be encountered during normal dispensing operations.

As can be appreciated, however, setting the time "T" based upon the worst case, i.e., longest, response time "R" will result in the actual valve open time "O" being longer than desired at times when the solenoid is responding faster than its worst case response time. This situation is illustrated in FIG. 4, which is identical to FIG. 3 except that the solenoid response time "R" is faster, i.e., shorter, than the worst case situation. As can be seen from FIG. 4, because of the preset timer time "T", the shorter solenoid response time "R" results in the valve actual open time "O" being longer than the desired valve open time "O" shown in FIG. 3.

As previously described, maintaining the valve in its open position longer than desired causes too much sealant to be dispensed to the closure members being coated and, thus, results in wasted sealant material. This over-dispensing will also cause the closure member to be coated over a greater number of turns than desired (e.g., over 2¼ turns rather than over exactly 2 turns). As previously described, such "over-turning" often interferes with the ability of the closure member to form an effective seal with the container to which it is ultimately affixed.

These problems are overcome by the present invention in which the timer is started only when the valve actually reaches its open position (point "b" in FIGS. 3 and 4) rather than when the solenoid is energized (point "a" in FIGS. 3 and 4), as will now be described in detail.

Figure 9:
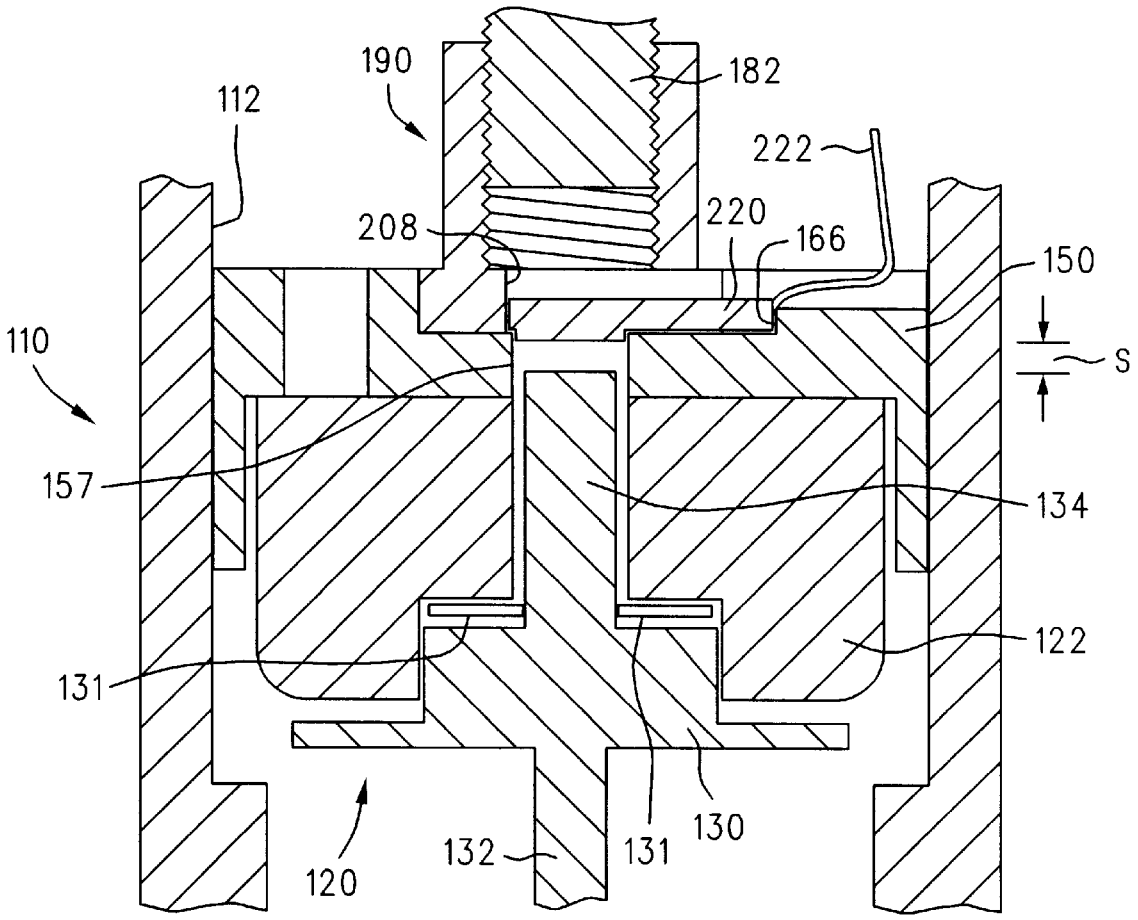
FIG. 9 is a cutaway detail view of a portion of the sealant dispensing gun of FIG. 1 showing the arrangement of a proximity sensor with respect to the transverse member of FIG. 5 and the mounting block member of FIG. 7 when the sealant dispensing gun is in its closed position.
Figure 10:
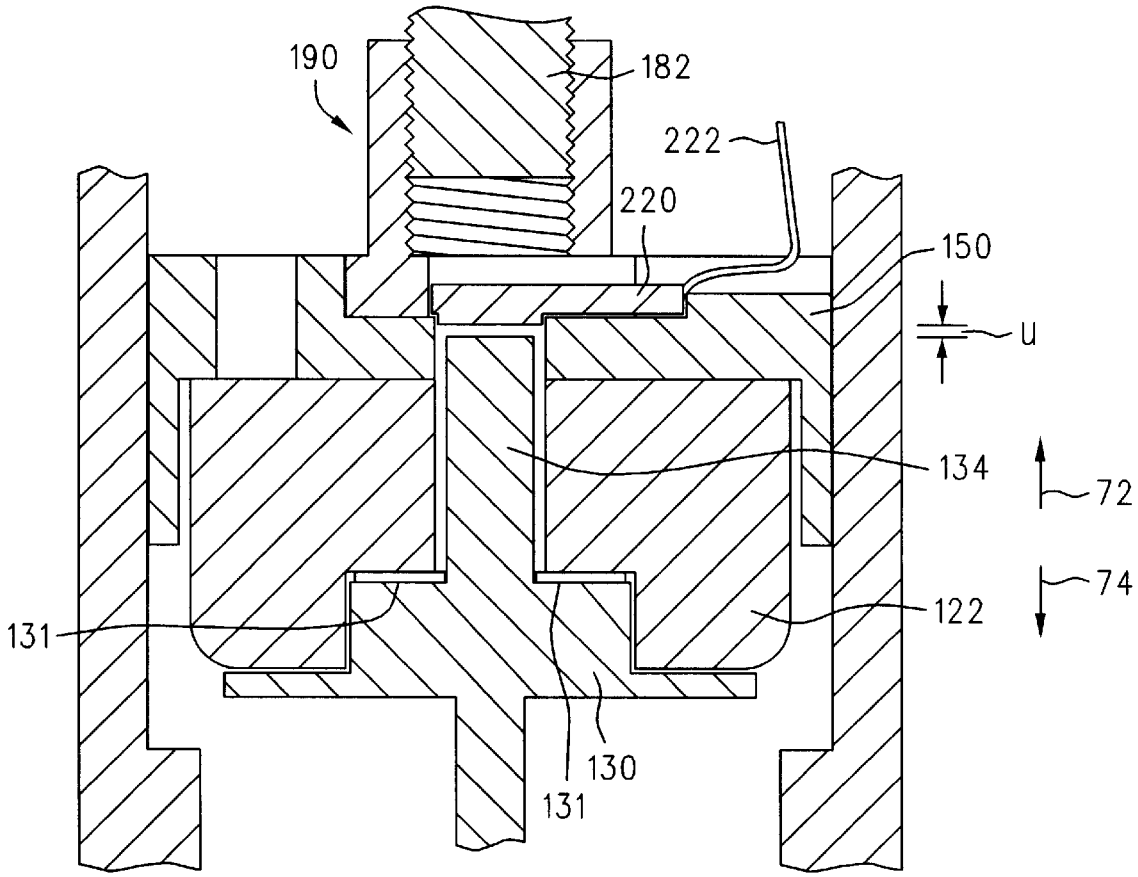
FIG. 10 is a cutaway detail view similar to FIG. 9, but showing the sealant dispensing gun in its closed position.

Referring to FIGS. 2, 9 and 10, a proximity sensor 220 may be provided in close proximity to the upper extending portion 134 of the solenoid armature 130. The proximity sensor 220 may, for example, be of the type commercially available from Honeywell, Inc. of 11 West Spring St., Freeport, Ill. 61032, and sold as a 922LC Series "Miniature Switch Style 3-wire DC Type" proximity sensor, Catalog Listing 922LC1,5A4N-Z4. The proximity sensor 220 may be mounted within the sealant dispensing gun 30 in a manner as will now be described in detail.

Referring to FIGS. 5 and 6, it can be seen that the transverse member 190 may include an upwardly extending annular collar portion 192 having threads 194, FIG. 6, located on the inner periphery thereof. The annular collar portion 192 may be integrally formed with a base portion 196. Base portion 196 may be a generally parallelepiped-shaped structure, but having a rounded key portion 198, FIG. 5, located at one end thereof and may have a height "e" of about 0.16 inches, FIG. 6, a length "f" of about 1.69 inches, FIG. 5, and a width "g" of about 0.75 inches. The base portion 196 may also include a pair of relatively smaller through holes 200, 202 and a relatively larger through hole 204 as shown in FIG. 5. A substantially rectangular notch 206 may be provided in the base portion 196 as shown. The notch 206 may have a rear wall 208, a first side wall 210 and a second sidewall 212, FIG. 5, as shown. The notch 206 also includes an open end 214 and may have a length "h", FIG. 6, of about 0.53 inches extending between the rear wall 208 and the open end 214 and a width "i", FIG. 5, of about 0.32 inches, extending between the first sidewall 210 and the second sidewall 212.

Figure 7:
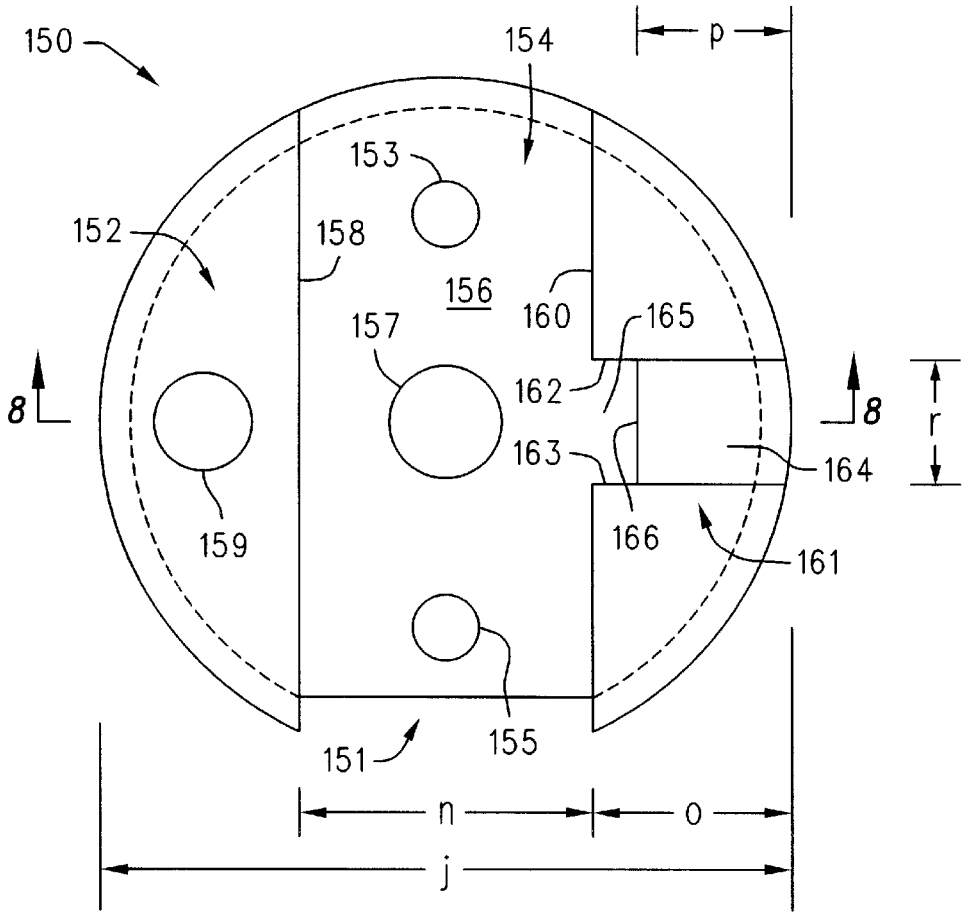
FIG. 7 is a top plan view of a mounting block member of the sealant dispensing gun of FIG. 1.
Figure 8:
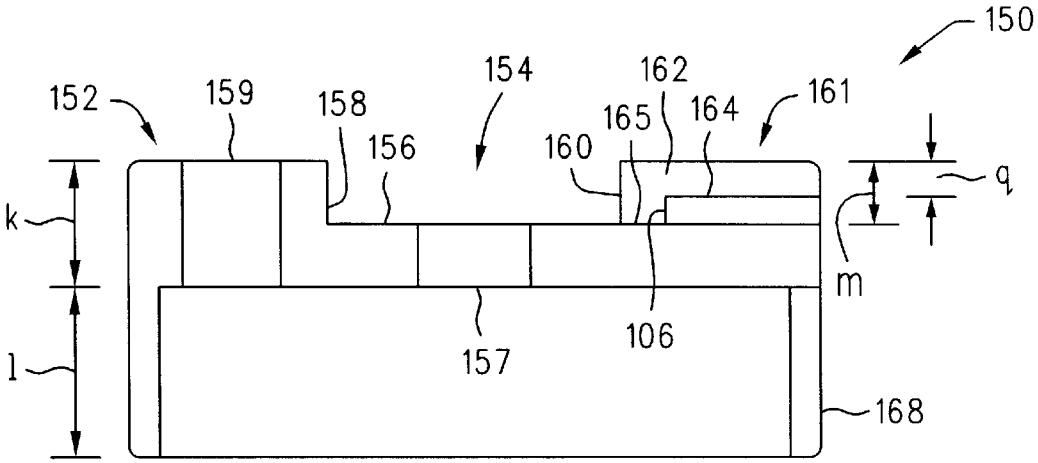
FIG. 8 is a cross-sectional elevation view taken along the line 8—8 in FIG. 7.

Referring to FIGS. 7 and 8, the mounting block member 150 may have a circular cross-section with a diameter "j" of about 1.77 inches, FIG. 7, and may generally include an upper wall portion 152, having a height "k" of about 0.32 inches, and an annular skirt portion 168 which extends downwardly therefrom and has a height "l" of about 0.43 inches, FIG. 8.

A channel 154 may extend completely across the mounting block upper wall portion 152 as shown. The channel 154 may have a height "m", FIG. 8, of about 0.16 inches, a width "n" of about 0.75 inches, FIG. 7, and may include a lower surface 156, a first side surface 158 and a second side surface 160. A notch 151, FIG. 7, may be located at one end of the channel 154 and may extend downwardly though the entire upper wall portion 152 and skirt 168.

A pair of relatively smaller through-holes 153, 155 and a relatively larger through-hole 157 may extend completely through the upper wall portion 152, terminating at the upper wall portion lower surface 156. A second relatively larger through-hole 159 may extend completely through the upper wall portion as shown in order to facilitate the manufacture of the mounting block 150.

A stepped transverse notch 161 may extend from the mounting block member outer periphery to the channel 154, as shown, for a distance "o", FIG. 7, of about 0.51 inches and may have a width "r" of about 0.32 inches. The notch 161 may include a first sidewall 162 and a second sidewall 163 extending for the entire distance "o". The notch 161 may include a relatively shallow portion having a bottom wall 164 which extends for a distance "p", FIG. 7, of about 0.40 inches from the outer periphery of the mounting block member 150. The bottom wall 164 terminates at a vertical wall 166 as shown. The notch 161 may also include a relatively deeper portion having a bottom wall 165 which extends from the vertical wall 166 to the second side surface 160 of the channel 154.

The relatively deeper portion of the notch 161 may have a depth which is equal to the depth "m", FIG. 8, of the channel 154. Accordingly, the bottom wall 165 of the notch relatively deeper portion may be substantially coplanar with the lower surface 156 of the channel 154. The relatively shallow portion of the notch 161 may have a depth "q", FIG. 8, of about 0.09 inches, as shown.

FIG. 9 illustrates the actuator solenoid assembly 120, mounting block member 150, transverse member 190 and proximity sensor 220 mounted within the dispensing gun middle housing portion 110. As can be seen, the transverse member 190 is mounted within the mounting block member channel 154, FIGS. 7 and 8. Mounted in this manner, the transverse member holes 200, 202, FIG. 5, align with the mounting block member holes 153, 155, FIG. 7, respectively. In a conventional manner, a pair of threaded studs, not shown, attached to the actuator solenoid field portion 122, may be extended through the aligned holes 153, 200 and 155, 202. A pair of nuts, not shown, may then be threaded onto the studs, thus securing the transverse member, mounting block member and actuator solenoid assembly as shown in FIG. 9. A pair of electrical leads, not shown, may be provided in a conventional manner in order to selectively supply electrical current to the solenoid field portion 122.

With further reference to FIG. 9, the proximity sensor 220 may mounted such that it is supported by the mounting block member channel lower surface 156 and transverse notch lower surface 165, FIG. 8, and partially overlies the opening 157 as shown. In this manner, the proximity sensor 220 is securely housed between the transverse member notch rear wall 208, the mounting block vertical wall 166 and the mounting block transverse notch first and second sidewalls 162, 163, FIG. 7.

The proximity sensor 220 may include wire leads 222 which allow the sensor to communicate with the system controller in a conventional manner, as will be described in further detail herein. The relatively shallow portion of the mounting block member transverse notch provides clearance for these leads 222 when the proximity sensor 220 is mounted as shown in FIG. 9.

FIG. 9 illustrates the fluid dispensing gun 30 in its closed position, i.e., when the needle valve tapered portion 76 is sealingly engaged within the valve seat surface 64, FIG. 2. In this position, a gap "s", FIG. 9, will exist between the proximity sensor 220 and the upper extending portion 134 of the actuator solenoid assembly armature 130. Due to the magnitude of the gap "s", the proximity sensor will not sense the presence of the upper extending portion 134 when the valve is in its closed position.

FIG. 10 illustrates the fluid dispensing gun 30 in its open position, i.e., when the needle valve tapered portion 76 is disengaged from the valve seat surface 64, FIG. 2, thus allowing sealant to be dispensed through the nozzle opening 62 in a manner as previously described. As can be seen from FIG. 10, the armature 130 has moved upwardly in the direction of the arrow 72 and is now in contact with the washer 131. As can further be seen, the armature upper extending portion 134 has moved into close proximity with the proximity sensor 220 such that the gap "u" between the proximity sensor 220 and the upper extending portion 134 is now significantly smaller than the gap "s", FIG. 9. Due to this smaller gap "u", the proximity sensor 220 is able to sense the presence of the upper extending portion 134 and send a corresponding signal along the leads 222. In this manner, the proximity sensor is able to accurately sense when the needle valve member has moved to its open position as shown in FIG. 10.

It is noted that the actuator solenoid upper extending portion 134 may easily be trimmed to the desired length in order to adjust the gap "u" and, thus, ensure that the upper extending portion 134 moves into close proximity with the sensor 220 when the valve has moved to its open position as shown in FIG. 10. The required proximity, i.e., the required size of the gap "u", depends upon the specific type of proximity sensor 220 used. In one example, however, the gap "u" may be set to be equal to about 1 mm.

As previously described, the extent to which the needle valve member 70 opens may be controlled by selectively activating the rotary adjustment solenoids 174, 176, FIG. 2. This activation causes rotation of the drive member 182 and longitudinal movement of the transverse member 190, mounting block member 150 and actuator solenoid assembly 120 in the directions 72, 74. This, in turn, moves the location of the valve fully open position, as shown in FIG. 10, in the directions 72, 74. Referring to FIG. 9, it can be appreciated that such adjustment will cause the gap "s" to change. Because the proximity sensor 220 is secured to the mounting block member 150, however, the gap "u", FIG. 10, will remain unaffected by this adjustment and, accordingly, the sensor 220 will always remain in the proper position to detect the valve in its open position.

Figure 11:
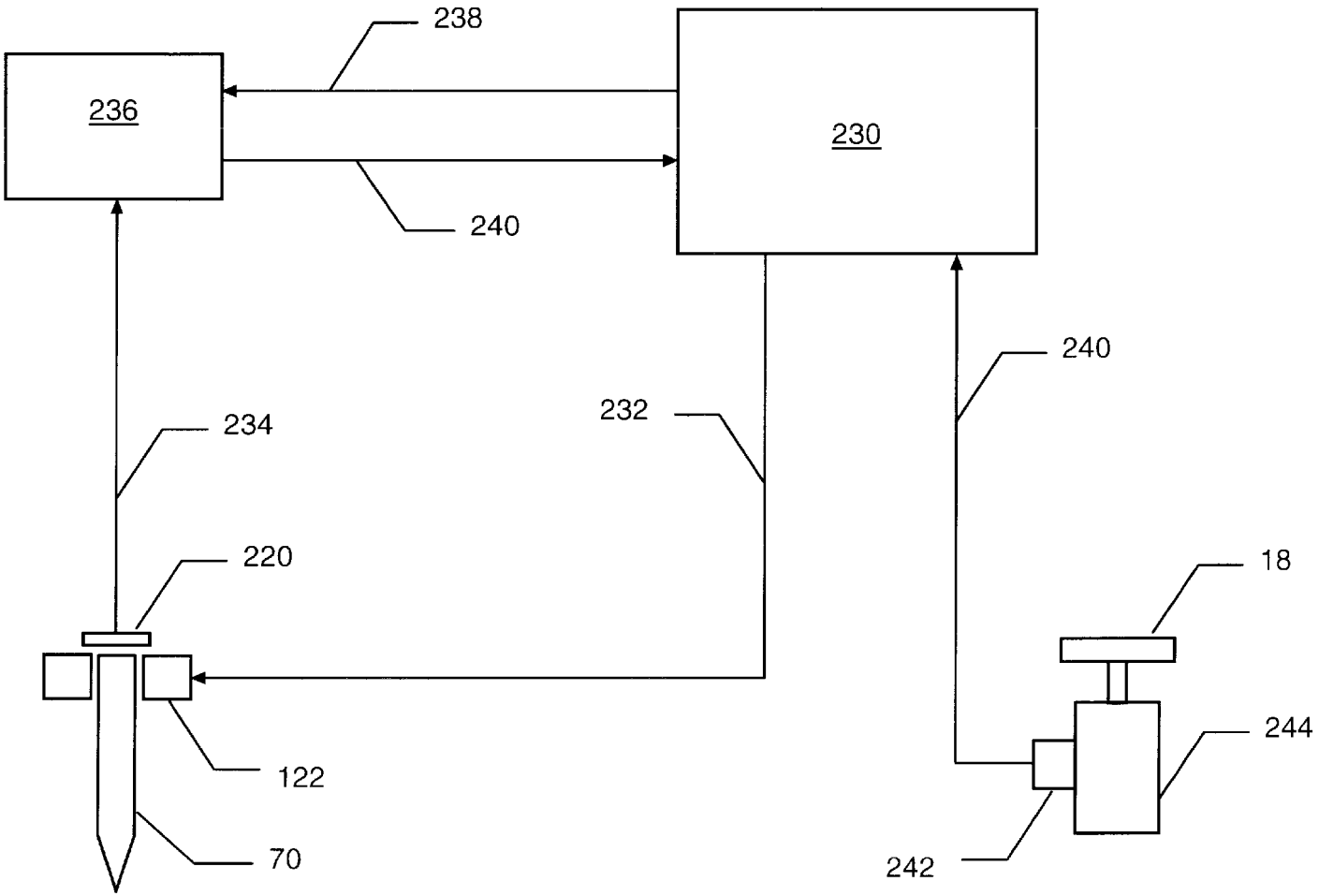
FIG. 11 is a schematic representation of the control circuitry used with the sealant dispensing gun of FIG. 1.
Figure 12:
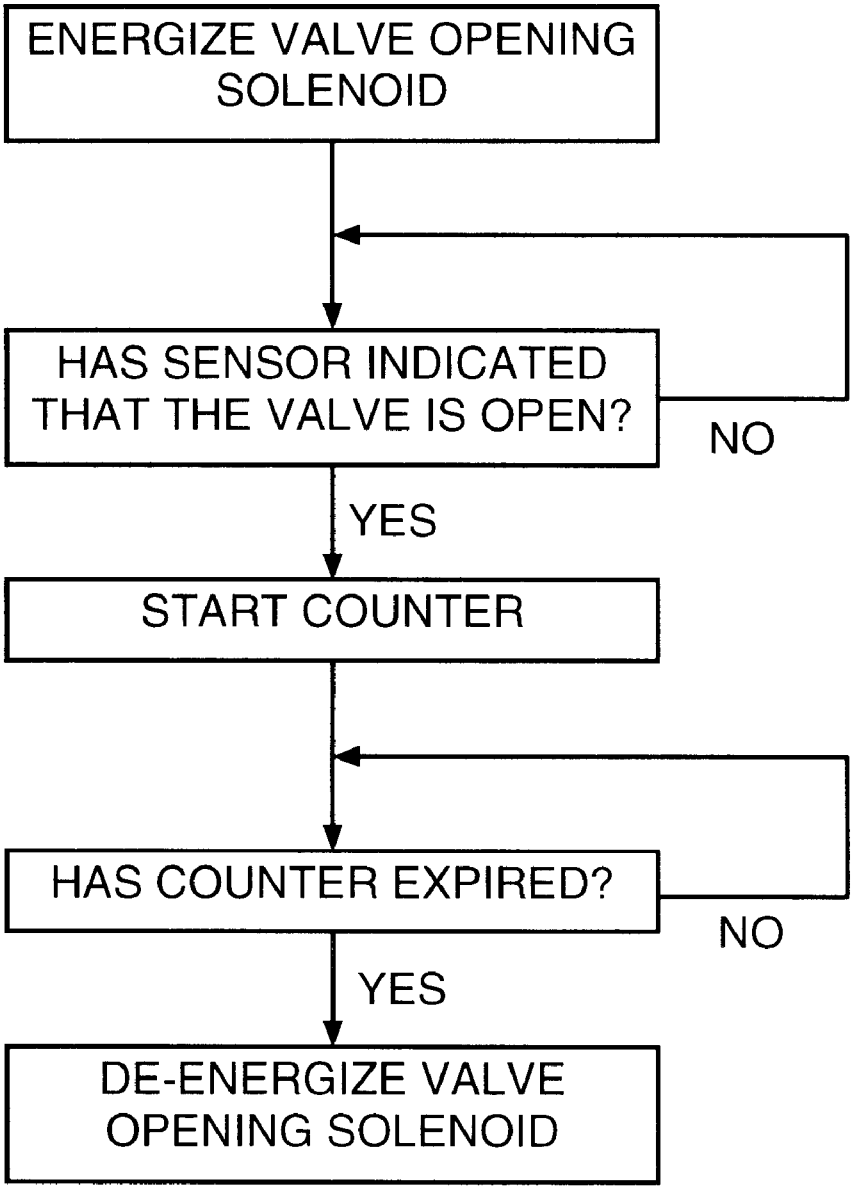
FIG. 12 is a flow chart illustrating the operation of the sealant dispensing gun of FIG. 1.

FIG. 11 schematically illustrates the operation of the proximity sensor 220. Referring to FIG. 11, it can be seen that, at the beginning of a valve opening cycle, the system controller 230 sends a signal 232 energizing the actuator solenoid assembly 120. When the needle valve member 70 actually moves to its open position (i.e., after the solenoid response time "R" has elapsed), the presence of the armature upper extending portion 134 is sensed by the proximity sensor 220 and an appropriate signal 234 is sent to a counter 236. Upon receiving the signal 234, the counter 236 begins measuring a valve open cycle for a predetermined duration. This predetermined duration may be set by the controller via a signal 238 as shown in a conventional manner. After the predetermined duration has been measured by the counter 236, a signal 240 is sent to the controller, causing the controller to de-energize the actuator solenoid assembly 120, thus causing the valve to close. The process described above is illustrated in flow chart format in FIG. 12

The counter 236 may be a conventional timing device. Alternatively, the counter 236 may be an integral part of the controller 230 and may, for example, comprise a software application performed by the controller 230 in a conventional manner. In this manner, the controller may set a predetermined time on the counter 236 via the signal 238. For this purpose, the controller may also include an input signal 240 from a transponder 242 operatively attached to the chuck drive motor 244, FIG. 11. In this manner, the rotational speed of the rotatable chuck 18 may be input to the controller. This rotational speed information may then be used by the controller to determine the desired valve opening time "T", depending upon the desired number of turns of coverage.

Alternatively, the counter 236 may be a rotational counter which receives the signal 240 directly from the transponder 242. In this manner, the desired number of turns may be programmed onto the counter by the controller 230 via the signal 238. The counter 236 may then directly count the number of turns completed by the chuck 18 and send the signal 240 to the controller 230 after the desired number of turns have occurred.

As can be appreciated, use of the proximity sensor 220 in a manner as described above allows the counter 236 to eliminate measuring the solenoid response time "R", FIGS. 3 and 4. The counter, instead, is able to measure only the desired valve open duration "T" and, thus, avoid the variability associated with the solenoid response time "R" as previously described.

Figure 10A:
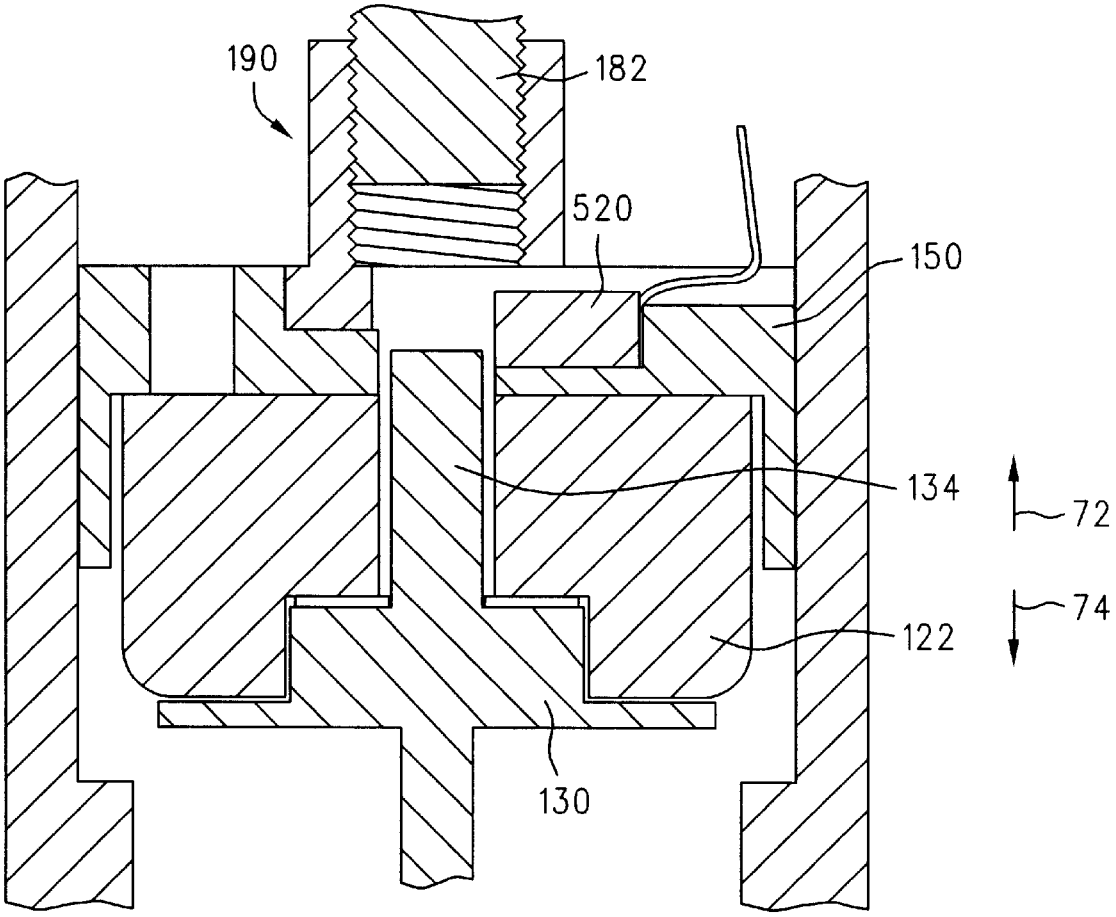
FIG. 10A is a cutaway detail view of a portion of the sealant dispensing gun of FIG. 1 showing the arrangement of an alternative proximity sensor when the sealant dispensing gun is in its closed position.

FIG. 10A illustrates an alternative arrangement for mounting a proximity sensor 520 in close proximity to the upper extending portion 134 of the solenoid armature 130. As can be appreciated from FIG. 10A, the proximity sensor 520 may be mounted so as to detect the solenoid armature upper extending portion 134 from the side thereof, rather from the top as in FIGS. 9 and 10. This side sensing arrangement is advantageous in that it generally results in less hysteresis effect problems than does the configuration shown, e.g., in FIGS. 9 and 10. The side sensing arrangement, thus, provides for more reliable sensing, particularly at high operating speeds. The side sensing arrangement also requires less precision in manufacture since the gap "s", FIG. 9, is eliminated and thus need not be maintained. The proximity sensor 520 may, for example, be of the type commercially available from Pepperl & Fuchs, 1600 Enterprise Parkway, Twinsburg, Ohio 44087 and sold as Model No. NJ0.6-3-22-E2. The side sensing sensor 520 as shown in FIG. 10A, in all other respects, may be constructed and operate in an identical manner to the sensor 220 previously described, with the exception that the mounting block member 150 and the transverse member 190 may be modified in an appropriate manner to properly house the side sensor 520.

As an alternative to the non-contact proximity sensors 220 and 520 previously described, a contact sensor such as a conventional contact switch may be used. Such a contact sensor may, for example, be mounted such that the armature upper extending portion 134 actually contacts the contact sensor when the fluid dispensing gun moves to its open position, e.g., FIG. 10. Accordingly, the contact sensor may sense when the fluid dispensing device has moved to its open position in a manner similar to that described previously with respect to the contact proximity sensors 220, 520. It is noted that, although a contact sensor as described above may be used, it is generally more desirable, in most operating situations, to use a non-contact sensor, such as the proximity sensors 220, 520, since the use of a contact sensor may result in undesirable wear to the armature upper extending portion 134, the contact sensor or to both.

It is noted that, although specific and preferred arrangements have been described for mounting a proximity sensor withing the sealant dispensing gun 30, the sensor could, alternatively, be mounted in any alternative manner which allows it to sense when the valve 70 has moved to its open position. It is further noted that, although the previous description involves a sealant dispensing gun having a solenoid or motor driven valve open limit adjustment mechanism, the sensor arrangement could also readily be used in conjunction with a gun having a manually adjustable valve open limit arrangement.

Valve Open Limit Adjustment

As previously described, the weight of sealant applied to closure members by a sealant dispensing gun commonly varies during operation. This variation sometimes results in closure members which have either too much or too little sealant material applied thereto.

Figure 13:
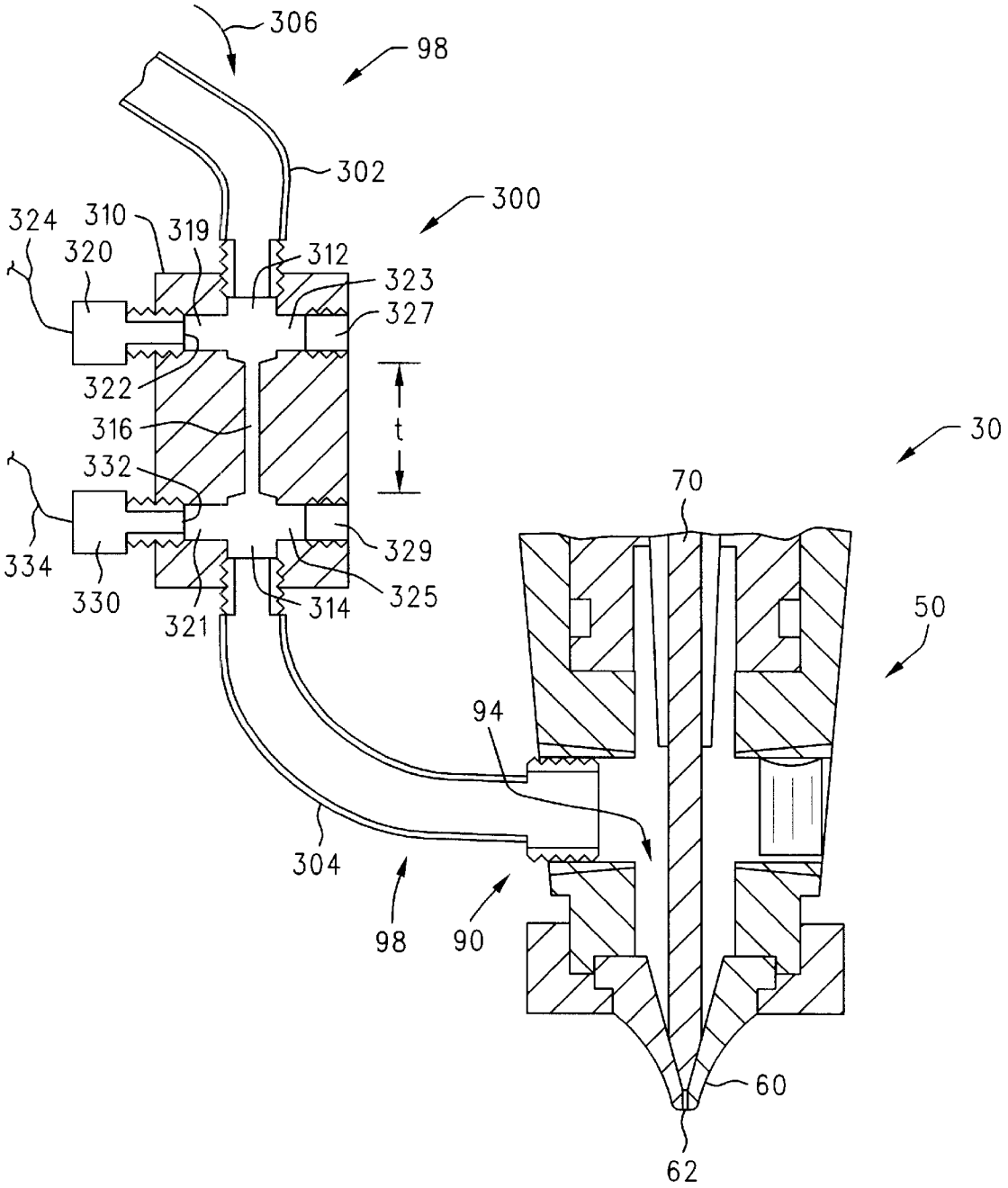
FIG. 13 is a cross-sectional elevation view of a flow measuring device attached to the sealant supply hose of the sealant dispensing gun of FIG. 2.

To address this problem, a sealant flow rate measuring device may be installed in-line with the sealant dispensing gun sealant supply hose 98, FIG. 2. The sealant flow rate measuring device may, for example, be a differential pressure device 300 as illustrated in FIG. 13. Such differential pressure devices are commonly used to determine fluid flow rates by measuring the pressure drop across a restricted flow passageway.

Referring to FIG. 13, the differential pressure device 300 may comprise a housing member 310 which includes a first chamber 312 and a second chamber 314 which may be substantially identical to the first chamber 312. The chambers 312, 314 are connected by a restricted flow passageway 316 which may be substantially cylindrical in shape, and which may have a diameter of about 0.125 inches and a length "t" of about 1.0 inch. Each of the chambers 312, 314 may also be substantially cylindrical in shape, and may each have a diameter of about 0.25 inches.

First and second threaded openings 319, 321 may extend through the differential pressure device housing 310 and communicate with the first and second chambers 312, 314, respectively. A first pressure transducer 320 may be threadingly received within the first threaded opening 319 such that transducer 320 is in fluid communication with the first chamber 312. In a similar manner, a second pressure transducer 330 may be threadingly received within the second threaded opening 321 such that transducer 330 is in fluid communication with the second chamber 314. Electrical leads 324, 334 may be connected to the pressure transducers 320, 330, respectively, in a conventional manner in order to transmit pressure readings from the sensors to a remote location as will be explained in further detail herein. Pressure transducers 320, 330 may be conventional pressure sensing transducer devices and may, for example, be of the type commercially available from Omega Engineering, Inc., P.O. Box 40407, Stamford, Conn. 06907 and sold as a Model PX102-100SV transducer.

The differential pressure device 300 may be located between a first portion 302 and a second portion 304 of the sealant supply hose 98 and may be connected to the first portion 302 and the second portion 304 in any conventional manner. In a preferred embodiment, however, the first and second supply hose portions 302, 304 may be threadingly attached to the differential pressure device 300 in a manner as illustrated in FIG. 13. Differential pressure device 300 may also include first and second threaded bleed openings 323 and 325 which extend through the differential pressure device housing 310 and communicate with the chambers 312, 314, respectively. The bleed openings 323, 325 may be fitted with air bleed valves 327, 329 in a conventional manner in order to facilitate the removal of air from the chambers 312, 314.

Because the fluid sealant contained within the supply hose 98 is pressurized, when the sealant dispensing gun valve needle valve member 70 moves to its open position as shown, for example, in FIG. 10, fluid sealant material will flow through the supply hose portion 302, the differential pressure device 300, the supply hose portion 304, the dispensing gun sealant chamber 94, and the sealant gun nozzle opening 62. This flow will continue until the needle valve member 70 moves to its closed position as shown, for example, in FIG. 9.

As the sealant material flows through the differential pressure device 300, it passes through the differential pressure device first chamber 312, the restricted passageway 316 and the second chamber 314. As can be appreciated, the pressure drop across the restricted passageway 316, i.e., the difference in pressure between the fluid sealant material in the first chamber 312 and the fluid sealant material in the second chamber 314, will be proportional to the rate of fluid flow through the restricted passageway 316. Accordingly, the pressure sensors 320, 330 may be used to determine the rate of flow through the restricted passageway 316, which is identical to the rate of flow of sealant being dispensed from the sealant dispensing gun nozzle 62 when the needle valve 70 is in its open position.

Figure 14:
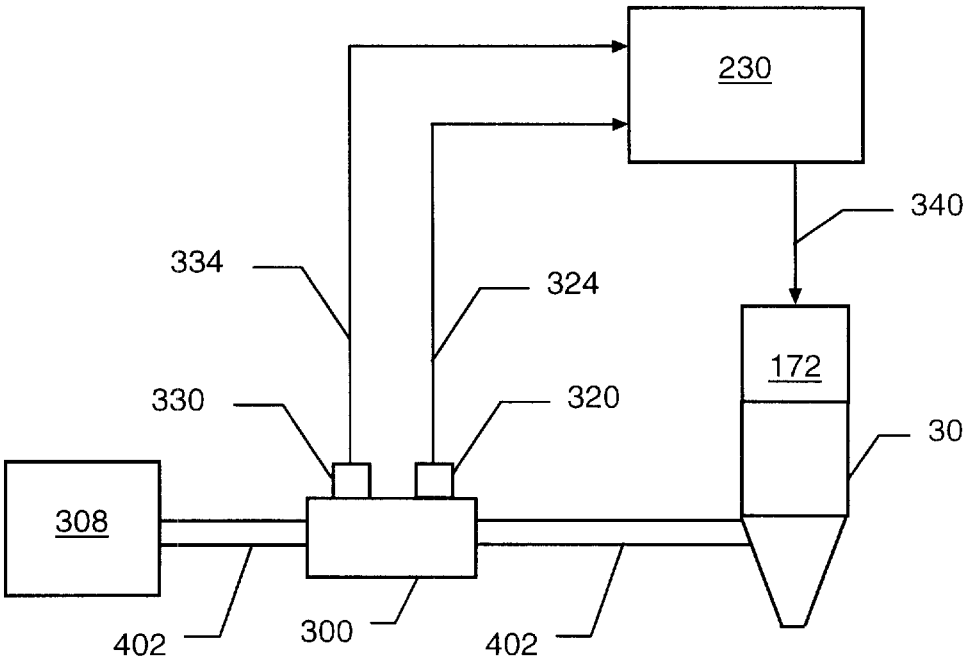
FIG. 14 is schematic representation of the control circuitry used with the flow measuring device of FIG. 13.

FIG. 14 schematically illustrates how the pressure data provided by the differential pressure device 300 may be used by the system controller 230 in order to automatically adjust the valve gap adjustment solenoid assembly 172 and, thus, automatically adjust the valve open limit and the amount of sealant dispensed by the sealant dispensing gun 30. Referring to FIG. 14, fluid sealant may be supplied to sealant dispensing gun 30 from a sealant supply source 308 via a sealant fluid path 402 which extends between the supply source 308 and the dispensing gun opening 62, FIG. 2. The fluid path 402 may include the sealant supply hose 98 previously described with reference, for example, to 2 and 13. A flow measuring device, such as the differential pressure device 300 previously described may be located in line with the sealant supply hose 98 as shown in FIG. 14. Pressure signals from the differential pressure device pressure sensors 320, 340 may be sent to the system controller 230 via the leads 324, 334, respectively. This pressure data may then be used by the controller 230, as will be explained in further detail herein, to determine the weight of sealant material being applied to the closure members during operation of the dispensing gun 30. When the controller determines that the weight of sealant being applied is unacceptably high or unacceptably low, then the controller may send a signal 340 to the valve gap adjustment solenoid assembly 172 in order to make the appropriate adjustment to the valve open limit.

Figure 15:
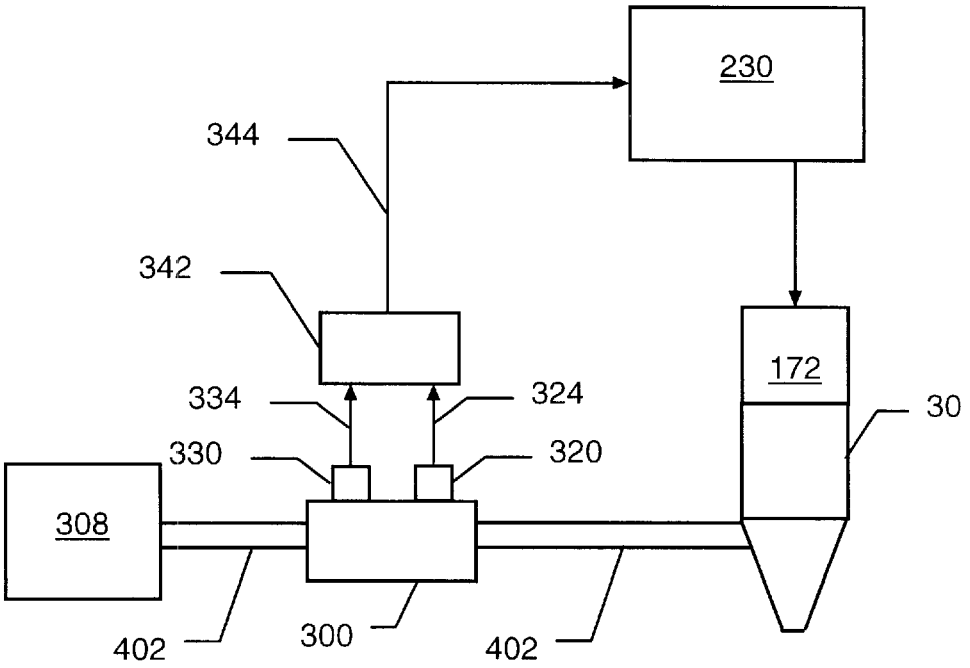
FIG. 15 is a schematic representation of an alternative embodiment of the control circuitry of FIG. 14.

Alternatively, as shown in FIG. 15, a separate processor 342 may be provided in order to resolve the pressure differential signals provided by the sensors 320, 330. A single signal 344, indicative of the pressure differential, may then be sent to the system controller 230.

The differential pressure device arrangement described above may be used in conjunction with either a single dispensing gun stationary indexing application or with a multiple gun rotary machine, as previously described. In order to reduce the number of pressure sensors required in a multiple gun rotary machine, however, an alternate arrangement as shown in FIG. 19 may be used as will now be described in detail.

Figure 19:
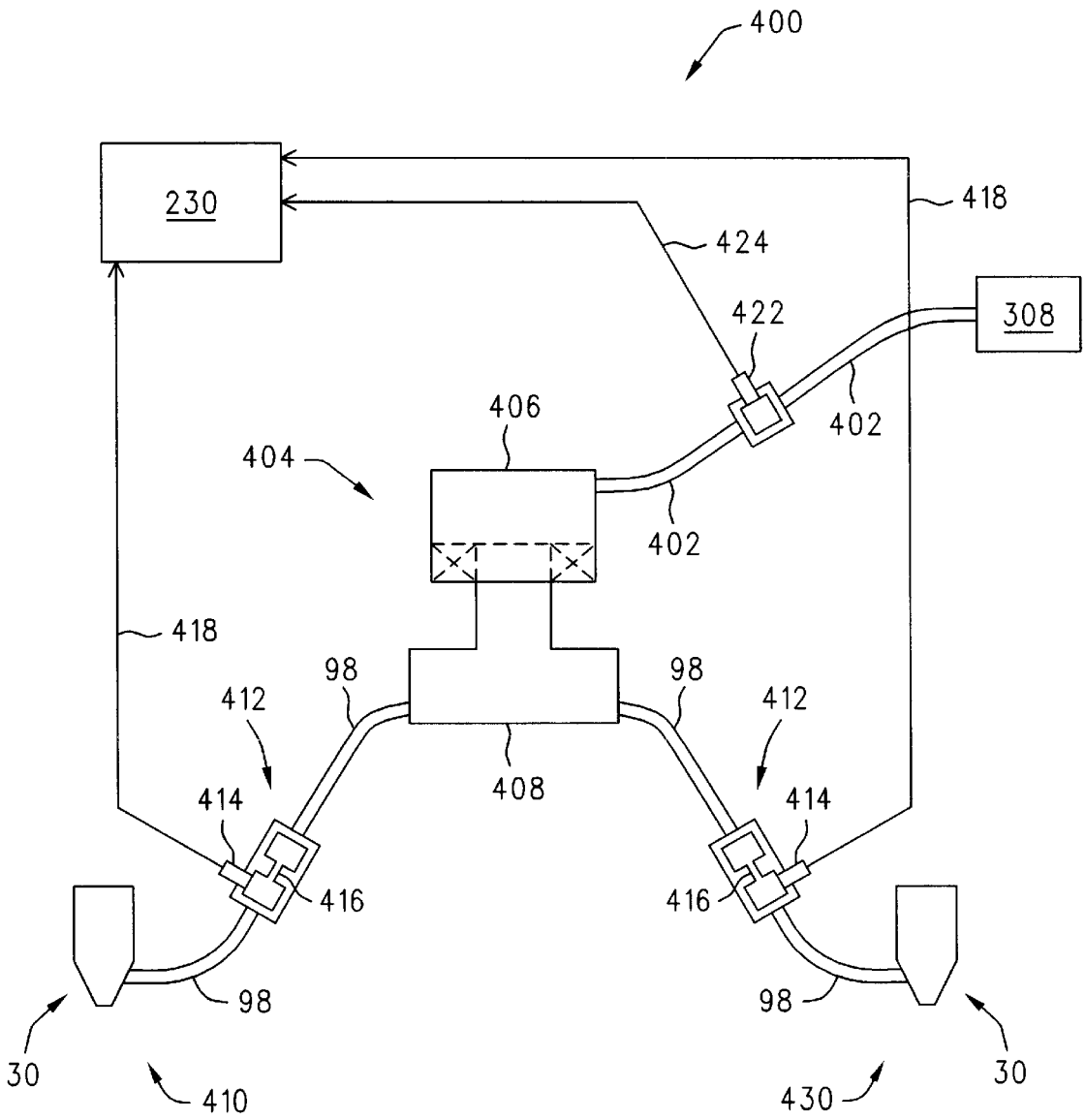
FIG. 19 is a schematic elevation view of the sealant dispensing system of FIG. 1 illustrating an alternate embodiment of the flow measuring device of FIG. 13.

FIG. 19 schematically illustrates a plurality of sealant applying stations, e.g., 410, 430, which are provided on a rotary sealant application machine 400. Sealant may be supplied to the application machine 400 from a sealant supply source 308 via a sealant fluid path 402. The fluid path 402 extends through a rotary union device 404 having a stationary portion 406 and a rotating manifold portion 408 in a conventional manner. Each station 410, 430 may include a sealant dispensing gun 30, as previously described. A sealant supply conduit 98 leading from the manifold 408 to the dispensing gun 30 may form a part of the fluid path 402. A restricted flow device 412 may be located in-line with each conduit 98 and may include a pressure transducer 414 located downstream of a restricted flow path 416.

A second pressure sensing device 422 may be provided in the fluid path 402, upstream of the rotary union 404 as shown. In this manner, the controller 230 may input pressure differential signals 418 from each of the dispensing station pressure sensors 414 and compare each of these signals 418 to the signal 424 from the pressure sensor 422 in order to derive pressure differential signals indicative of each dispensing station 30. Accordingly, each dispensing station supply conduit 98 may incorporate only one pressure sensing device, rather than two as previously described.

I. System Calibration

Figure 16:
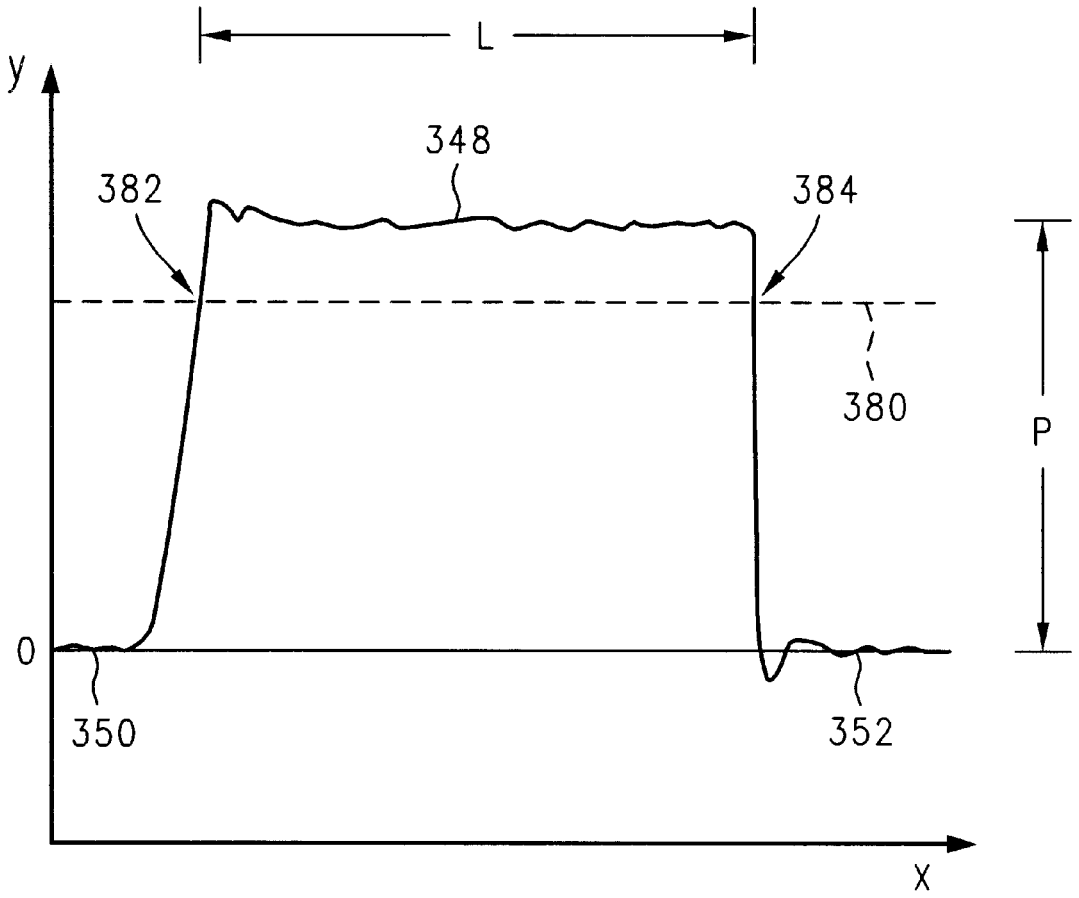
FIG. 16 is a graphical representation illustrating pressure differential vs. time as measured by the flow measuring device of FIG. 13.

FIG. 16 illustrates, in graphical form, the output 348 from a flow measuring device, such as the differential pressure device 300, over one dispense cycle of the sealant dispensing gun 30. Referring to FIG. 16, the x axis of the graph indicates time, while the y axis indicates the pressure drop measured by the differential pressure device 300. As can be appreciated from an examination of FIG. 16, when the pressure differential is substantially equal to zero, such as at the points 350, 352, no sealant material is flowing through the supply line 98 and dispensing gun opening 62, FIG. 2. When the pressure differential is greater than zero, however, e.g., over the time period "L", sealant material is flowing through the supply line 98 and the dispensing gun opening 62. As can further be appreciated, the magnitude of pressure differential, as measured on the y axis, will be proportional to the rate of flow of sealant material through the supply line 98 and dispensing gun opening 62. The average magnitude of pressure differential over the time period "L" is indicated as "P" in FIG. 16.

In order to correlate a specific pressure differential to a specific rate of sealant flow, it is first necessary to calibrate the measurement system by creating correlation data. Although the use and calibration of differential pressure flow rate measurement devices is conventional, one exemplary method of calibration will now be set forth.

A first closure member may be pre-weighed to determine its initial weight before the application of sealant thereto. With the dispensing gun valve open limit set to a first setting, the first closure member may then be run through the sealant dispensing system such that a quantity of sealant is applied to it by the sealant dispensing gun 30. As the sealant is applied, pressure differential readings, such as those graphically illustrated in FIG. 16, are obtained from the differential pressure device 300. These readings may be obtained, for example, every 0.5 milliseconds. The flow time period "L1" for the first closure member may be measured and the pressure differential readings may be averaged to obtain the average pressure differential "P1" for the first closure member.

After application of the sealant material, the first closure member may then be re-weighed and the new weight compared to the initial weight to determine the weight "W" of sealant applied to the first closure member. The weight "W" of sealant material applied may then be divided by the first closure member flow time period "L1" to obtain a first weight flow rate "R1" which corresponds to a pressure differential reading "P1".

After completing the above steps, the dispensing gun valve open limit may be set to a second setting and the process may be repeated for a second closure member. Because the valve open limit has been changed, this will result in a second weight flow rate "R2" being correlated to a second pressure differential reading "P2". This process may be repeated until a sufficient range of pressure differential readings are correlated to corresponding weight flow rates.

Accordingly, after completing the steps outlined above, a correlation chart will be formed from which a specific weight flow rate can be correlated to a particular pressure differential measured by the differential pressure device 300. This correlation chart may be stored in the system controller 230 in a conventional manner.

It is noted that, in the calibration method set forth above, rather than using one closure member for each valve setting, a plurality, e.g., ten, closure members may be used and the average of the pressure drops "P" and the time periods "L" for the group may be used in the calculations.

As can be appreciated, after calibration is completed, the controller 230 will be capable of correlating a specific weight flow rate to any pressure drop measured by the differential pressure device 300. Further, by multiplying the average flow rate by the measured time period "L" for a particular closure member, the actual weight of sealant material applied to the closure member can be calculated by the controller.

II. System Operation

Using the pressure differential data, as described above, the controller 230, e.g., FIGS. 14 and 15, is able to track the weight of sealant being applied to each closure member and automatically make adjustments to the valve gap adjustment solenoid assembly 172 in order to adjust the amount of sealant being applied to subsequent closure members in a manner as will now be described in detail.

Figure 17:
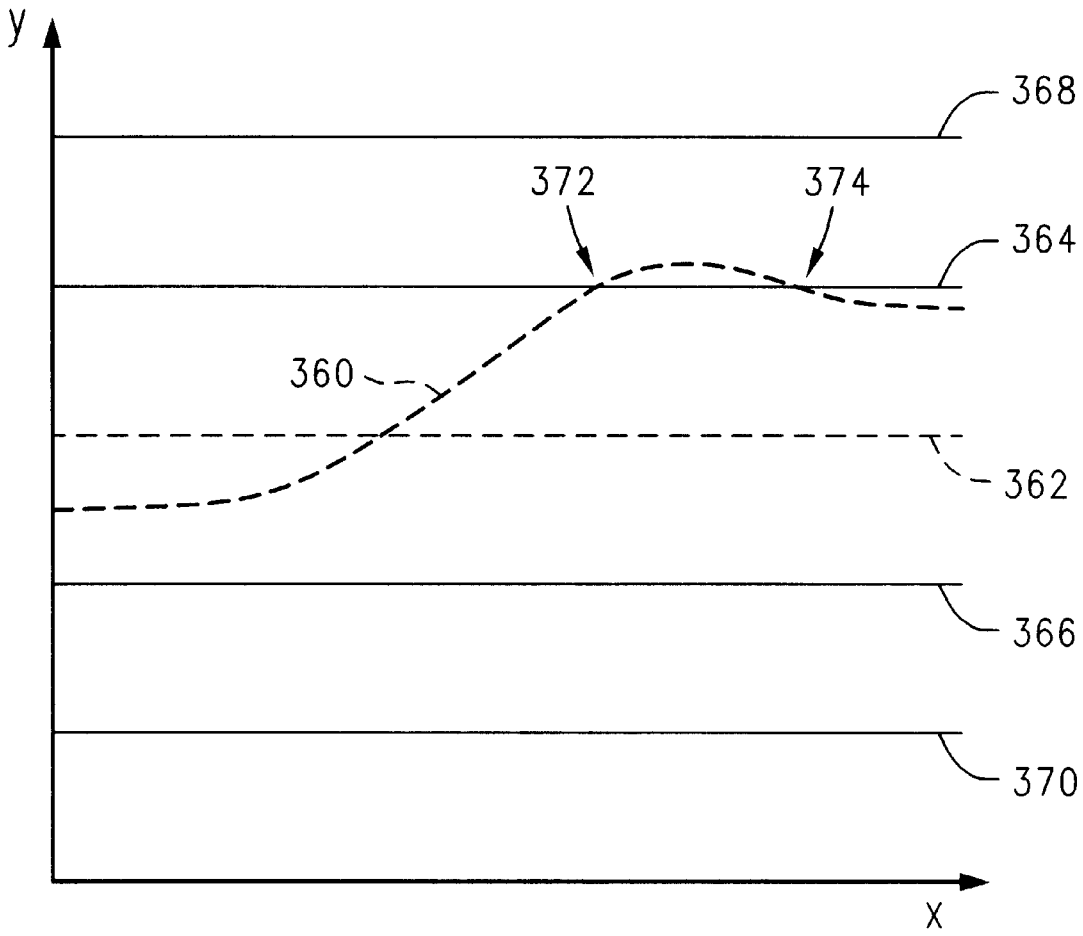
FIG. 17 is a graphical representation illustrating sealant weight per closure member vs. time.
Figure 18:
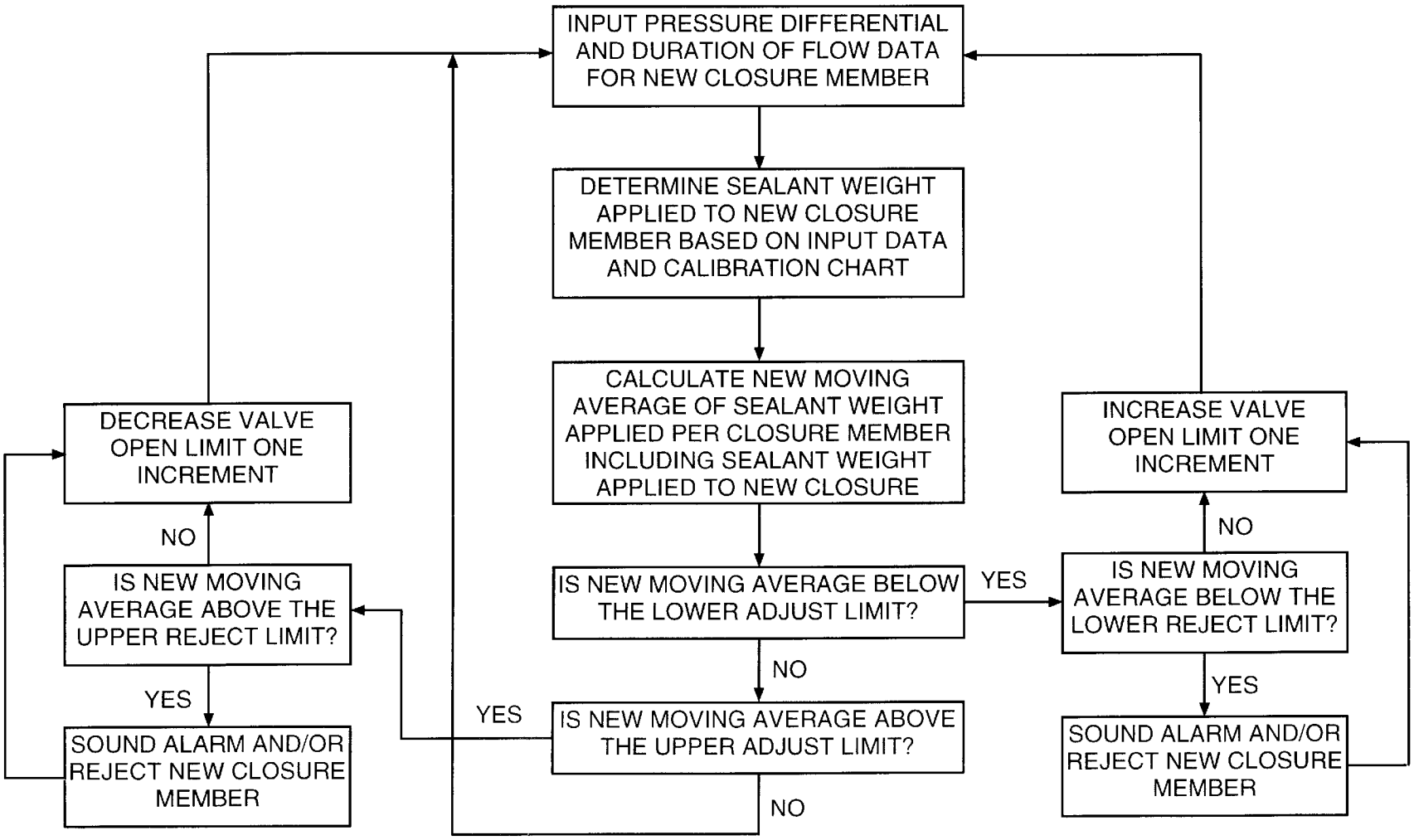
FIG. 18 is a flow chart illustrating the operation of the sealant dispensing gun of FIG. 1 and the flow measuring device of FIG. 13.

FIG. 17 is a graphical illustration in which time is indicated on the x-axis and sealant weight applied per closure member is indicated on the y axis. The dashed line 362 indicates the desired weight of sealant per closure member. An upper adjust threshold 364 and a lower adjust threshold 366 may be equally spaced above and below the target weight line 362 as shown. The upper adjust threshold 364 indicates the level at which the controller 230 will begin to decrease the valve open limit, i.e., cause the valve member 70, FIG. 2, to open to a lesser extent by activating the valve gap adjustment solenoid assembly 172 in first rotary direction. This, in turn, will cause the valve actuator solenoid assembly 120 to move in the direction 74, FIG. 2, thus decreasing the valve open gap and decreasing the flow rate of sealant from the sealant gun dispensing opening 62.

The lower adjust threshold 366 indicates the level at which the controller 230 will begin to increase the valve open limit, i.e., cause the valve member 70, FIG. 2, to open to a greater extent by activating the valve gap adjustment solenoid assembly 172 in second rotary direction. This, in turn, causes the valve actuator solenoid assembly 120 to move in the direction 72, FIG. 2, thus increasing the valve open gap and increasing the flow rate of sealant from the sealant gun dispensing opening 62.

An upper reject threshold 368 and a lower reject threshold 370 may also be equally spaced above and below the target weight line 362 as shown. The upper and lower reject thresholds 368, 370 indicate the levels at which closure members will be rejected and/or operation of the sealant dispensing system will be halted.

In one example, the desired weight of sealant applied per closure member level 362 may be about 48 mg, the upper adjust threshold 364 may be about 50 mg, the lower adjust the lower adjust threshold 366 may be about 46 mg, the upper reject threshold 368 may be about 52 mg and the lower reject threshold 370 may be about 44 mg.

The dashed line 360 in FIG. 17 represents an example in which the sealant weight applied to a series of closure members is increasing over time. This is a situation which might occur, for example, as the temperature rises in a closure manufacturing facility during the day. Such a temperature rise will result in a lowering of the viscosity of the sealant material and, thus a higher rate of flow for a given valve open limit setting.

Continuing with the example, as the sealant weight 360 reaches the upper adjust limit 364, at the point indicated by the reference numeral 372, the controller 230 will signal the valve gap adjustment solenoid assembly 172 to rotate an incremental amount in a first direction, causing the valve actuator solenoid assembly 120 to move in the direction 74, FIG. 2, thus decreasing the valve open limit and decreasing the flow rate of sealant from the sealant gun dispensing opening 62. If this adjustment still does not result in the sealant weight 360 moving below the upper adjust limit 364, additional incremental adjustments of the solenoid assembly 172 may be initiated until the sealant weight 360 moves below the adjust limit 364 as indicated, for example, at the point 374.

In some situations, such as in a case where the sealant dispensing gun dispensing opening 62 becomes clogged, it may not be possible to correct the sealant weight by adjusting the solenoid assembly 172. In such a case, if the sealant weight 360 reaches one of the reject limits 368, 370, operation of the machine may be halted and/or an alarm may be sounded indicating the existence of the problem to a human operator. The methodology described above is illustrated in flow-chart format in FIG. 18.

In this manner, the controller 230 is able to track sealant weights being applied to closure members and to automatically adjust the sealant dispensing gun valve gap adjustment solenoid assembly 172 as necessary.

It is noted that the applied sealant rates tracked by the controller 230, as represented by the line 360 in FIG. 17, may actually represent a moving average of a quantity, e.g., fifty, closure members, rather than a series of individual closure members.

It is further noted that, although a pressure differential device is disclosed as an example of a flow rate monitoring device, any type of flow rate monitoring device could, alternatively, be used in conjunction with the automatic valve gap adjustment method set forth herein.

The valve gap adjustment apparatus and method described above may be used in conjunction with the valve dwell time adjustment apparatus and method previously described. Accordingly, the operations depicted in FIGS. 11 and 12 may be combined with the operations depicted in FIGS. 14, 15 and 18 so that the controller 230 may automatically adjust both the valve dwell time, i.e., the sealant lap, and the valve open limit, i.e., the sealant weight applied to each closure member. When these operations are combined in this manner, it is preferable to first adjust the valve dwell time and sealant lap and thereafter proceed with adjusting the valve open limit and sealant weight since the valve dwell time adjustment will affect the sealant weight. In other words, when combining the valve dwell time and valve open limit adjustment operations, it is desirable to first carry out the dwell time adjustment operation illustrated in FIG. 12 and to thereafter initiate the valve open limit adjustment operation illustrated in FIG. 18.

III. Valve Opening Detection

In addition to monitoring sealant weight, the sealant flow measuring device, such as the differential pressure device 300 previously described, may also be used to sense when the dispensing gun valve 70, FIG. 2, is in its open, sealant dispensing position and when it is in its closed, non-flow position.

As previously described, FIG. 16 graphically illustrates the pressure differential vs. time information supplied by the pressure differential device 300 for one open cycle of the dispensing gun valve 70. Referring to FIG. 16, a threshold level 380 may be established which may be equal, for example, to about 75% of the average magnitude of pressure differential "p". Accordingly, the controller 230 may identify the point at which sealant flow initially begins as the first point in time 382 where the pressure differential reaches the threshold level 380. In a similar manner, the controller 230 may identify the point at which sealant flow ends as the point in time 384 where the pressure differential falls below the threshold level 380.

As can be appreciated, under normal operating conditions, the point 382 will substantially coincide in time with the point "b", FIGS. 3 and 4, at which the valve actually opens and the point 384 will substantially coincide in time with the point "d", FIGS. 3 and 4, at which the valve actually closes. Accordingly, the differential pressure device 300, or other flow rate measuring device, may be used in place of the proximity sensor 220, e.g., FIGS. 2, 9 and 10, previously described in order to determine the when the sealant dispensing gun valve 70 opens and closes.

It has been found, however, that in certain abnormal operating conditions, the points 382 and 384, FIG. 16, may not coincide in time with the actual valve opening and closing points "b" and "d", respectively. For this reason, it is preferable to have the controller 230 monitor both sealant flow rate and the signals from the proximity sensor 220 as previously described. Operating in this manner, the abnormal operating conditions mentioned above can be detected as will now be described in detail.

One such abnormal operating condition occurs when the dispensing gun opening 62, FIG. 2, becomes partially or completely clogged. This may result in a delay in the initiation of sealant flow after the valve 70 has moved to its open position until the clog is forced out of the opening 62 by the pressure of the sealant. If the clog is large enough, flow may be completely prevented during the entire time that the valve 70 is in its open position. An example of a clogged nozzle abnormal operating condition is graphically illustrated in FIG. 20, which is similar in format to FIG. 16, previously described.

Figure 20:
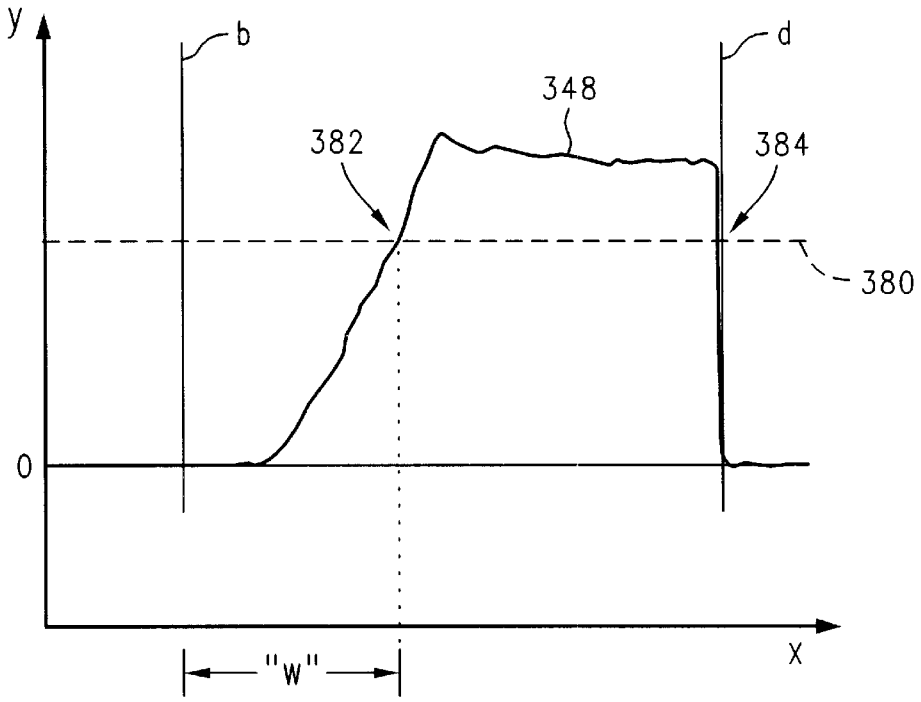
FIG. 20 is a graphical representation illustrating pressure differential vs. time and an abnormal operating condition.

Referring to FIG. 20, the pressure differential output curve 348 crosses the threshold level 380 at the point 382. As can be seen, however, there is an abnormal time delay "w" between the time "b" when the valve actually opens (as indicated by the proximity sensor 220) and the point 382. This abnormal delay is caused by a partially clogged opening 62. In operation, the controller 230 is able to monitor the delay "w" between the time "b" and the point 382 and, when an abnormal delay "w" is sensed, the controller may halt operation of the sealant dispensing system and alert a human operator of the problem.

Another abnormal operating condition occurs when the sealant dispensing gun valve 70, FIG. 2, fails to properly seat upon closing. This situation may occur, for example, when a particle of foreign matter becomes lodged between the valve 70 and the valve seat 64 or when either of these components is damaged. An example of an improperly seated valve abnormal operating condition is graphically illustrated in FIG. 21, which is similar in format to FIGS. 16 and 20, as previously described.

Figure 21:
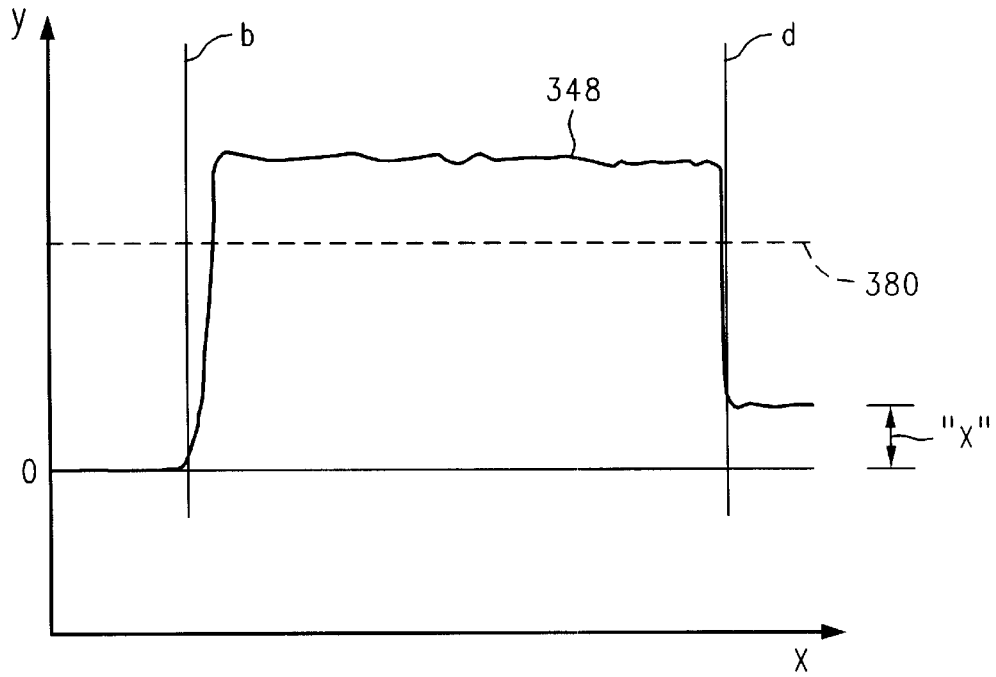
FIG. 21 is a graphical representation illustrating pressure differential vs. time and another abnormal operating condition.

Referring to FIG. 21, it can be seen that the pressure differential output curve 348 fails to return to zero after the proximity sensor 220 has indicated that the valve has closed at point "d". This abnormal situation may be caused by an improperly seated valve member 70, as previously described. In operation, if the controller 230 detects that the flow rate is greater than zero when the proximity sensor 220 indicates that the valve is closed (i.e., after the time "d"), then the controller may halt operation of the sealant dispensing system and alert a human operator of the problem.

Accordingly, use of both the proximity sensor 220 and the flow rate sensor 300 as previously described allows the system controller to accurately measure and control valve dwell time and valve open limit and to detect abnormal operating conditions.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A sealant dispensing apparatus for applying sealant to container closure members comprising:

a housing;

a valve seat surface located within said housing;

a plunger including a valve portion, said plunger axially movably mounted in said housing and being selectively axially movable between a closed non-flow position in which said valve portion is engaged with said valve seat surface and an open sealant applying position in which said valve portion is disengaged from said valve seat surface;

an actuator mounted in said housing and operatively associated with said plunger;

a sensor located proximate at least a portion of said plunger; and a signal processor assembly having a signal input portion operatively connected to said sensor and having a signal output portion operatively connected to said actuator.

2. The apparatus of claim 1 wherein said actuator comprises an actuator solenoid.

3. The apparatus of claim 2 wherein:

said plunger comprises a lower portion including said valve portion and an upper portion comprising an armature portion; and said armature portion is at least partially surrounded by said actuator solenoid.

4. The apparatus of claim 3 wherein said sensor is positioned proximate said plunger armature portion.

5. The apparatus of claim 1 wherein said sensor is a proximity sensor.

6. The apparatus of claim 3 wherein said armature portion is relatively closer to said sensor when said plunger is in said open sealant applying position and relatively further from said sensor when said armature portion is in said closed non-flow position.

7. A sealant dispensing system for applying sealant to container closure members comprising:

a sealant dispensing apparatus including a sealant dispensing opening therein;

a sealant supply source located externally of said sealant dispensing apparatus;

a sealant supply path connecting said sealant supply source and said sealant dispensing opening;

a valve seat located within said sealant supply path;

a valve member located within said sealant supply path, said valve member being selectively movable between an open sealant applying position and a closed non-flow position relative to said valve seat;

a flow gap defined between said valve seat and said valve member when said valve member is in said open sealant applying position;

a valve actuator operatively connected to said valve member;

a flow gap size adjustment solenoid operatively connected to said valve actuator solenoid;

a flow sensor operatively associated with said sealant supply path, said flow sensor adapted to sense the rate of sealant flow along said path;

a signal processing assembly having a signal input portion operatively connected to said flow sensor and a signal output portion operatively connected to said flow gap size adjustment solenoid.

8. The sealant dispensing system of claim 7 wherein said valve actuator is a solenoid actuator.

9. The sealant dispensing system of claim 7 wherein said flow sensor is a differential pressure device.

10. The sealant dispensing system of claim 7 wherein said signal processing assembly signal output portion is operatively connected to said valve actuator.

11. The sealant dispensing system of claim 10 and further comprising:

a proximity sensor located proximate at least a portion of said valve member; and said signal processor assembly signal input portion operatively connected to said proximity sensor.

12. The sealant dispensing system of claim 11 wherein said valve member is relatively closer to said proximity sensor when said valve member is in said open sealant applying position and relatively further from said proximity sensor when said valve member is in said closed non-flow position.

13. The sealant dispensing system of claim 7 and further comprising:

a proximity sensor located proximate at least a portion of said valve member; and said signal processor assembly signal input portion operatively connected to said proximity sensor.

14. A method of applying sealant to container closure members with at least one sealant applying mechanism, comprising:

providing a sealant supply source located externally of said sealant applying mechanism;

connecting said sealant supply source and said sealant applying mechanism with a sealant flow path;

providing a valve seat associated with said sealant applying mechanism and located within said sealant flow path;

providing a valve member associated with said sealant applying mechanism and located within said sealant flow path, said valve member being selectively moveable between a closed non-flow position, in which said valve member is in contact with said valve seat, and an open sealant applying position, in which a flow gap is formed between said valve member and said valve seat;

monitoring flow of sealant through said sealant flow path while sealant is applied to each of a plurality of said container closure members by said sealant applying mechanism;

adjusting said flow gap based upon said monitoring of said flow of sealant through said sealant flow path.

15. The method of claim 14 wherein said monitoring flow of sealant through said sealant flow path comprises measuring the rate of flow and the duration of flow of sealant through said sealant flow path while sealant is applied to said each of a plurality of said container closure members.

16. The method of claim 15 wherein said adjusting said flow gap based upon said monitoring of said flow of sealant through said sealant flow path comprises calculating the amount of sealant material applied to said each of a plurality of said container closure members.

17. The method of claim 16 wherein said calculating the amount of sealant material applied to said each of a plurality of said container closure members comprises calculating the weight of sealant material applied to said each of a plurality of said container closure members.

18. The method of claim 17 wherein said adjusting said flow gap based upon said monitoring of said flow of sealant through said sealant flow path comprises calculating a moving average of said weight of sealant material applied for said plurality of container closure members and comparing said moving average to at least one predetermined limit.

19. The method of claim 14 wherein said monitoring flow of sealant through said sealant flow path is accomplished with a flow monitoring device which is located within said sealant flow path.

20. The method of claim 19, and further including:

(a) sensing when said valve member is in said open sealant applying position with said flow monitoring device;

(b) maintaining said valve member in said open sealant applying position for a predetermined duration beginning substantially when said flow monitoring device senses that said valve member is in said open sealant applying position.

21. The method of claim 20 wherein said maintaining said valve member in said open sealant applying position for a predetermined duration comprises maintaining said valve member in said open sealant dispensing position for a predetermined period of time beginning substantially when said flow monitoring device senses that said valve member is in said open sealant applying position.

22. The method of claim 20 and further including providing a controller for controlling the operation of said at least one sealant applying mechanism.

23. The method of claim 20 and further including:

(a) providing a proximity sensor adapted to sense when said valve member is in said open sealant applying position; and (d) sensing when said valve member has reached said open sealant applying position with said proximity sensor.

24. The method of claim 23 and further including:

(a) providing a valve actuator operatively connected to said valve member;

(b) providing a controller having a signal input portion which is operatively connected to both said flow monitoring device and said proximity sensor and a signal output portion which is operatively connected to said valve actuator.

25. The method of claim 24 and further including:

(a) sending a first signal from said flow monitoring device to said controller when said flow monitoring device senses that said valve is in said open sealant applying position; and (b) sending a second signal from said proximity sensor to said controller when said proximity sensor senses that said valve is in said open sealant applying position.

26. The method of claim 25 and further including comparing the relative timing of said first and second signals in order to determine whether said sealant applying mechanism is malfunctioning.

27. The method of claim 26 including determining that said sealant applying mechanism is malfunctioning if said first signal and said second signal do not occur at substantially the same time.

28. The method of claim 14 and further including:

(a) providing a proximity sensor adapted to sense when said valve member is in said open sealant applying position;

(b) moving said valve member toward its open sealant applying position;

(d) sensing when said valve member has reached said open sealant applying position with said proximity sensor;

(e) maintaining said valve member in said open sealant applying position for a predetermined duration beginning substantially when said proximity sensor senses that said valve member is in said open sealant applying position.

29. The method of claim 28 wherein said maintaining said valve member in said open sealant applying position for a predetermined duration comprises maintaining said valve member in said open sealant applying position for a predetermined period of time beginning substantially when said proximity sensor senses that said valve member is in said open sealant applying position.

30. The method of claim 29 and further including providing a controller for controlling the operation of said at least one sealant applying mechanism.

31. The method of claim 30 and further including sending a signal to said controller from said proximity sensor indicating when said valve member has reached said open sealant applying position.

32. The method of claim 28 wherein said sensing comprises sensing a portion of said valve member with said proximity sensor.

33. A method of applying sealant to container closure members with at least one sealant applying mechanism and at least one rotatable member for supporting a container closure member, comprising:

(a) providing a valve located within said at least one sealant applying mechanism, wherein said valve is movable between an open sealant dispensing position and a closed position;

(b) providing a first sensor adapted to sense when said valve is in said open, sealant dispensing position;

(c) moving said valve toward its open sealant dispensing position;

(d) sensing when said valve has reached said open, sealant dispensing position with said first sensor;

(e) maintaining said valve in said open sealant dispensing position for a predetermined duration beginning substantially when said first sensor senses that said valve is in said open sealant dispensing position.

34. The method of claim 33 wherein said maintaining said valve in said open sealant dispensing position for a predetermined duration comprises maintaining said valve in said open sealant dispensing position for a predetermined period of time beginning substantially when said first sensor senses that said valve is in its open, sealant dispensing position.

35. The method of claim 33 wherein said maintaining said valve in said open sealant dispensing position for a predetermined duration comprises maintaining said valve in said open sealant dispensing position for a predetermined number of rotations of said rotatable member beginning substantially when said first sensor senses that said valve is in its open, sealant dispensing position.

36. The method of claim 33 and further including providing a controller for controlling the operation of said at least one sealant applying mechanism.

37. The method of claim 36 and further including sending a signal to said controller from said first sensor indicating when said valve is in said open sealant dispensing position.

38. The method of claim 33 wherein said first sensor is a proximity sensor.

39. The method of claim 38 wherein said sensing comprises sensing a portion of said valve with said proximity sensor.

40. The method of claim 33 wherein said first sensor is a flow sensor.

41. The method of claim 40 wherein said flow sensor comprises a differential pressure device.

42. The method of claim 40 wherein said sensing comprises sensing a flow rate of sealant being supplied to said sealant applying mechanism.

43. The method of claim 40 and further including:

(a) providing a second sensor adapted to sense when said valve is in said open sealant dispensing position, wherein said second sensor is a proximity sensor; and (b) sensing when said valve is in said open sealant dispensing position with said second sensor.

44. The method of claim 38 wherein said sensing when said valve is in said open sealant dispensing position with said first sensor comprises sensing a portion of said valve with said first sensor.

45. The method of claim 43 and further including:

(a) providing a valve actuator operatively connected to said valve;

(b) providing a controller having a signal input portion which is operatively connected to both said first sensor and said second sensor and a signal output portion which is operatively connected to said valve actuator.

46. The method of claim 45 and further including:

(a) sending a first signal from said first sensor to said controller when said first sensor senses that said valve is in said open sealant dispensing position; and (b) sending a second signal from said second sensor to said controller when said second sensor senses that said valve is in said open sealant dispensing position.

47. The method of claim 46 and further including comparing the relative timing of said first and second signals in order to determine whether said sealant applying mechanism is malfunctioning.

48. The method of claim 47 and further including determining that said sealant applying mechanism is malfunctioning if said first signal and said second signal do not occur at substantially the same time.

49. A sealant dispensing system, including at least one sealant applying mechanism, for applying sealant to container closure members comprising:

a sealant supply;

a fluid path providing fluid communication between said sealant supply and said sealant dispensing mechanism;

a valve seat located within said sealant applying mechanism and within said fluid path;

a valve member located within said sealant applying mechanism and within said fluid path, said valve member being selectively movable relative to said valve seat between an open sealant applying position in which a flow gap is defined between said valve member and said valve seat and a closed non-flow position in which said valve member is in contact with said valve seat;

a valve actuator operatively connected to said valve member;

a first sensor located within said fluid path, said first sensor adapted to sense the rate of sealant flow along said fluid path;

a signal processing assembly having a signal input portion operatively connected to said first sensor and a signal output portion operatively connected to said valve actuator.

50. The sealant dispensing system of claim 49 wherein said valve actuator comprises a valve actuator solenoid.

51. The sealant dispensing system of claim 49 wherein said first sensor comprises a differential pressure device.

52. The sealant dispensing system of claim 49 wherein a second sensor is located proximate at least a portion of said valve member and said signal processor assembly signal input portion is operatively connected to said second sensor.

53. The apparatus of claim 52 wherein said second sensor is a proximity sensor.

54. The apparatus of claim 52 and further comprising:

a flow gap size adjustment solenoid operatively connected to said valve actuator;

said signal processing assembly signal output portion operatively connected to said flow gap size adjustment solenoid.

55. The apparatus of claim 1 wherein:

said plunger is axially moveable along a first axis; and said first axis intersects said sensor.

56. The apparatus of claim 1 wherein:

said plunger has a terminal end thereof; and said sensor is located proximate said plunger terminal end.

57. The method of claim 33 wherein:

said valve is moveable between said open sealant dispensing position and said closed position along a first axis; and said providing a first sensor comprises intersecting said first sensor with said first axis.

* * * * *

UNITED STATES PATENT AND TRADEMARK OFFICE

CERTIFICATE OF CORRECTION

PATENT NO. : 6,010,740

DATED : Jan. 4, 2000

INVENTOR(S) : Rutledge et al.

It is certified that error appears in the above-identified patent and that said Letters Patent is hereby corrected as shown below:

Tilte page, item [57]

IN THE ABSTRACT

Line 18, delete the first instance of "the processor".

Column 1, (line 8), after "closures" insert --.--.
Column 2, (line 44), delete "3,412,971," and insert therefor --3,412,971;--.
Column 2, (line 45), after "and" delete "in".
Column 2, (line 60), after "5,749,969" insert --,--.
Column 13, (line 3), delete "though" and insert therefor --through--.
Column 13, (line 51), after "may" insert --be--.
Column 16, (line 5), delete "withing" and insert therefor --within--.
Column 20, (line 9), after "50 mg," delete "the lower adjust".
Column 21, (line 22), delete "p" and insert therefor --"P"--.
Column 21, (line 37), after "determine" delete "the".

UNITED STATES PATENT AND TRADEMARK OFFICE

CERTIFICATE OF CORRECTION

PATENT NO. : 6,010,740

DATED : Jan. 4, 2000

INVENTOR(S) : Rutledge et al.

It is certified that error appears in the above-identified patent and that said Letters Patent is hereby corrected as shown below:

Column 24, (line 65), delete "(d)" and insert therefor --(b)--.
Column 25, (line 32), delete "(d)" and insert therefor --(c)--.
Column 25, (line 35), delete "(e)" and insert tehrefor --(d)--.

Signed and Sealed this

Twenty-seventh Day of February, 2001

*Attest:*

Nicholas P. Godici

NICHOLAS P. GODICI

*Attesting Officer*

*Acting Director of the United States Patent and Trademark Office*